US007467970B2

(12) United States Patent
Ikuta et al.

(10) Patent No.: US 7,467,970 B2
(45) Date of Patent: Dec. 23, 2008

(54) PAIR OF FLAT-TYPE FLEXIBLE CABLE CONNECTORS AND HARNESS OF FLAT-TYPE FLEXIBLE CABLE

(75) Inventors: Keiichiro Ikuta, Osaka (JP); Masato Naganawa, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/822,013

(22) Filed: Jun. 29, 2007

(65) Prior Publication Data

US 2008/0009180 A1 Jan. 10, 2008

(30) Foreign Application Priority Data

Jun. 30, 2006 (JP) ..... 2006-180676

(51) Int. Cl.
*H01R 12/24* (2006.01)

(52) U.S. Cl. ..... 439/496

(58) Field of Classification Search ..... 439/496, 439/358, 460, 677, 680
See application file for complete search history.

(56) References Cited

U.S. PATENT DOCUMENTS 3,079,579 A * 2/1963 Crimmins et al. ..... 439/287
3,159,447 A * 12/1964 Crimmins et al. ..... 439/496
5,690,510 A * 11/1997 Chishima ..... 439/496
7,128,596 B2 10/2006 Masaki et al.

FOREIGN PATENT DOCUMENTS

JP 2005-004994 A 1/2005
JP 2005-166364 A 6/2005

* cited by examiner

*Primary Examiner*—Phuong K Dinh
(74) *Attorney, Agent, or Firm*—Rader, Fishman & Grauer, PLLC

(57) ABSTRACT

A pair of flat-type flexible cable connectors of the present invention comprise a first connector and a second connector. The first connector is provided with a plate-like cable holder, which has flat end faces on both sides in a thickness direction and an end protruding in the depth direction, and is structured to make an end of a flat-type flexible cable, the end having its insulating coating removed except a leading end part to expose conductors and being inverted, extend and contact both the end faces of the cable holder with the bent part of the exposed conductors serving as a boundary, and hold the leading end part and the root end part of the end. The second connector is provided with a plurality of terminals to contact the exposed conductors respectively.

17 Claims, 17 Drawing Sheets

PAIR OF FLAT-TYPE FLEXIBLE CABLE CONNECTORS AND HARNESS OF FLAT-TYPE FLEXIBLE CABLE

BACKGROUND OF THE INVENTION

1. Field of the Invention

The present invention belongs to a field of electric connectors and relates to a pair of flat-type flexible cable connectors to be used in connecting a flat-type flexible cable comprising a plurality of conductors laid side by side in a width direction in a flat-type insulating coating and to a harness using one connector thereof.

2. Description of Related Art

Japanese Patent Publication (Unexamined) No. 2005-4994 discloses a plug-type connector that is capable of easily connecting a pair of flexible flat cables (FFCs) by temporarily holding end parts of a pair of FFCs on corresponding mounting faces of mounting frames of a holder and fitting an annular part of a clamping member on the end parts of FFCs and the mounting frames and locking locking parts of the clamping member on locked parts of the holder. The FFC disclosed in the literature has a reinforcing sheet of synthetic resin attached on the back face of its end, and this reinforcing sheet aligns and holds exposed conductors being exposed from the end part of the FFC.

Japanese Patent Publication (Unexamined) No. 2005-166364 discloses a terminal, which has a contact point for an FFC, said contact point comprising a folded edge, and which exhibits excellent ease in inserting a flat cable into a connector housing. In the FFC disclosed in the literature, in a leading end part, an upper film is removed to expose conductors, and a reinforcing member comprising a resinous thin plate is attached onto the lower face of the leading end part to reinforce the leading end part and prevent it from bending.

SUMMARY OF THE INVENTION

As illustrated in FIG. 16, when such connectors serving as first connectors 902 are connected to both the ends of a given length of an FFC 901 having N conductors, and these first connectors 902 are connected to counterpart connectors serving as second connectors 903, respectively, it is a basic connection form that two first connectors 902 are arranged to oppose to each other in the same position, and in parallel with this, two second connectors 903 are arranged to oppose to each other in the same position. In this case, the first pole being the far left pole when seen in the fitting direction of the second connector 903 of one side is connected to the Nth pole being the far right pole when seen in the fitting direction of the second connector 903 of the other side (hereinafter referred to as 1-N connection). In contrast to this, to connect poles of the same number of both second connectors 903 (hereinafter referred to as 1-1 connection), as illustrated in FIG. 17, the first connectors 902 and the second connectors 903 are set in the same arrangement as FIG. 16, and one end of the FFC 901 is twisted to invert the obverse side and the reverse side and then connected to one first connector, or as illustrated in FIG. 18, in the arrangement of FIG. 16, the obverse side and the reverse side of the first connector 902 and the second connector 903 of one side are inverted and they are connected to the FFC 901.

Usually, prior to harness production, it is a practice to attach a reinforcing sheet of synthetic resin on the reverse side of both the ends of the FFC 901 to align and hold the exposed conductors of the FFC 901. In the cases of the connection forms of FIG. 17 and FIG. 18, the obverse side and the reverse side of the FFC 901 and those of the first connector 902 of one side are inverted from the normal connection form, and accordingly, if the terminals of the first connectors 902 are used as they are, the contact points of the terminals will contact not the exposed conductors on the obverse side of the FFC 901 but the reinforcing sheet attached on the reverse side, and electric connection can not be made. As a result, terminals having a contact point at a different location are prepared and assembled in the first connector. This, however, increases the kinds of terminals and invites cost increase. On the other hand, another possible measure is to attach a reinforcing sheet on the reverse side of the end of one side of the FFC 901 and attach a reinforcing sheet on the obverse side of the end of another side thereof. This, however, increases the kinds of the FFC 901 and invites cost increase. Another possible measure is to use terminals of two-contact-point type wherein the terminal contacts both the obverse side and the reverse side of the FFC. This, however, makes one contact point contact a reinforcing sheet, and in turn poses possible defects such as feeling odd in responses at the time of insertion or withdrawal and generation of damages on the reinforcing sheet due to repeated insertion and withdrawal.

The present invention was made in view of these points, and one object thereof is to provide a pair of flat-type flexible cable connectors, wherein conductors of an end of an FFC or another flat-type flexible cable are exposed, and at a time of harness production the end of the flat-type flexible cable is inverted so that a leading end part thereof comes closer to one face of the flat-type flexible cable or to the other face thereof, and the positions in the thickness direction of the first connector and the second connector being to be connected to the end are changed accordingly, thus choice between 1-N connection and 1-1 connection can be made at will, and in turn, increase in cost can be avoided by not increasing the kind of the terminal or the kind of the flat-type flexible cable, and even when a two-contact-point type is used, insertion and withdrawal can be made reliably, and a harness of flat-type flexible cable using one connector thereof.

To accomplish said object, a pair of flat-type flexible cable connectors according to the present invention comprise a first connector to be connected to an end of a flat-type flexible cable comprising a plurality of conductors laid side by side in a flat-type insulating coating, the width direction of the first connector to be aligned with the direction of laying of the conductors; and a second connector to be fitted with or disconnected from the first connector by inserting or withdrawing in a depth direction perpendicular to said width direction; the first connector being provided with a plate-like cable holder having flat end faces on both sides in a thickness direction perpendicular to both the width direction and the depth direction and having an end in the depth direction protruding into a side of fitting with the second connector, and being structured to make the end of the flat-type flexible cable, said end of the flat-type flexible cable having the insulating coating removed except a leading end part to expose the conductors and being inverted by bending an intermediate part of the exposed conductors in an approximately-U-shape, extend and contact both said end faces with the bent part of the exposed conductors serving as a boundary, and hold the leading end part of the end of the flat-type flexible cable and the root end part thereof located opposite to the leading end part with the exposed conductors located in between them; the second connector comprising a second connector body being able to be fitted with the first connector, and a plurality of terminals being provided on the second connector body and laid side by side in the width direction to contact the exposed conductors of the end of the flat-type flexible cable upon fitting the second connector body with the first connector; fitting parts of the first connector and the second connector being provided asymmetrical in the thickness direction to prevent reverse fitting or fitting the first connector with the second connector the other way around in the thickness direction; and the pair of flat-type flexible cable connectors being structured to prevent reverse connection or connecting the inverted end of the flat-type flexible cable to the first connector the other way around in the thickness direction.

The inverted end of the flat-type flexible cable is made to extend and contact both end faces in the thickness direction of the cable holder of the first connector, with the bent part of the exposed conductors serving as a boundary, and the leading end part and the root end part of the end of the flat-type flexible cable are held by the first connector. When the first connector and the second connector are fitted together, the terminals will contact the exposed conductors of the end of the flat-type flexible cable respectively.

For convenience of description, both end faces in the thickness direction of each of the flat-type flexible cable, the first connector and the second connector are termed and distinguished as face A and face B. The insulating coating of one end of the flat-type flexible cable is removed except the leading end part to expose the conductors. Then an intermediate part of the exposed conductors is bent in an approximately-U-shape so that the leading end part comes closer to the face A of the flat-type flexible cable; this inverts the end of the flat-type flexible cable. The first connector is connected to this end. Of the two end faces in the thickness direction of the first connector, one end face that eventually comes to the same side as the face A of the flat-type flexible cable is defined as the face A. Then, the first connector is connected to the second connector. Of the two end faces in the thickness direction of the second connector, one end face that comes eventually to the same side as the face A of the flat-type flexible cable is defined as the face A. Then, when the other end of the flat-type flexible cable is connected to the first connector in a connection form similar to that described above, the face A of the flat-type flexible cable, the face A of the first connector and the face A of the second connector come to the same side. Thus, with the flat-type flexible cable extending straight in between, two first connectors are opposed to each other in the same position, and corresponding to this, the second connectors are opposed to each other in the same position, and the 1-N connection is realized.

In contrast to this, one end of the flat-type flexible cable is connected to the first connector in a connection form different from one described above, and the other end is connected to the first connector in a connection form similar to one described above. In other words, the insulating coating of one end of the flat-type flexible cable is removed except a leading end part to expose the conductors. Then, an intermediate part of the exposed conductors is bent in an approximately-U-form so that the leading end part comes closer to the face B of the flat-type flexible cable, and in turn the end of the flat-type flexible cable is inverted. When the first connector is connected to this end, the face B of the first connector comes to the same side as the face A of the flat-type flexible cable. Next, when the first connector is connected to the second connector, the face B of the second connector comes to the same side as the face A of the flat-type flexible cable. As a result, with the flat-type flexible cable extending straight in between, two first connectors are opposed to each other in mutually-opposite positions in the thickness direction, and in parallel with this, the second connectors are opposed to each other in mutually-opposite positions in the thickness direction; thus 1-1 connection is realized.

As described above, at the time of production of the harness, the end of the flat-type flexible cable is so inverted that the leading end part thereof comes closer to the face A or the face B of the flat-type flexible cable, and the positions in the thickness direction of the first connector and the second connector that are connected to the end change accordingly; thus this allows choice between 1-N connection and 1-1 connection at will. In this case, although there is a difference that the leading end part of the end of the flat-type flexible cable is inverted to come closer to the face A of the flat-type flexible cable or closer to the face B thereof, the positioning of the exposed conductors in relation to the cable holder does not change, hence just one kind of terminal is needed for the second connector, and there is no need of increasing the kinds of the terminals; this reduces the cost. Moreover, in contrast to the conventional practice, no reinforcing sheet is attached to the flat-type flexible cable, hence there is no need of increasing the kinds of the flat-type flexible cable, and this reduces the cost. Furthermore, if the terminals are of a two-contact-point type wherein contact points are provided on both sides in the thickness direction of the cable holder, both the contact points will contact the exposed conductor, hence there is no possibility of defects such as feeling odd in responses at the time of insertion or withdrawal and generation of damages on the flat-type flexible cable due to repeated insertion and withdrawal; reliable insertion and withdrawal is provided.

Accordingly, when the pair of flat-type flexible cable connectors of the present invention are used, conductors of an end of a flat-type flexible cable are exposed, and at a time of harness production the end of the flat-type flexible cable is inverted so that a leading end part thereof comes closer to one face of the flat-type flexible cable or to the other face thereof, and the positions in the thickness direction of the first connector and the second connector being to be connected to the end are changed accordingly, thus choice between 1-N connection and 1-1 connection can be made at will, and in turn, increase in cost can be avoided by not increasing the kind of the terminal or the kind of the flat-type flexible cable, and even when terminals of a two-contact-point type are used, insertion and withdrawal can be made reliably.

The pair of flat-type flexible cable connectors of the present invention may be so arranged that the first connector is divided into a first connector body that is capable of fitting with the second connector and is provided with a through hole penetrating in the depth direction, and a cable holder, the cable holder is fitted in the first connector body by inserting the cable holder in the depth direction into the through hole of the first connector body to make the end thereof protrude into the side of fitting with the second connector, the pair of flat-type flexible cable connectors are structured to prevent reverse mounting or mounting the inverted end of the flat-type flexible cable on the cable holder the other way around in the thickness direction, and fitting parts of the cable holder and the first connector body are provided asymmetrical in the thickness direction to prevent reverse fitting or fitting the cable holder into the first connector body the other way around in the thickness direction.

With this arrangement, when the end of the flat-type flexible cable is mounted on the cable holder and they are fitted in the through hole of the first connector body, the first holder will be connected to the end of the flat-type flexible cable, hence the workability is high and moreover, reverse mounting of the flat-type flexible cable on the cable holder and reverse fitting of the cable holder into the first connector body are prevented; thus 1-N connection or 1-1 connection can be made reliably.

Accordingly, when the first connector is divided into a first connector body and a cable holder that fits into it, 1-N connection or 1-1 connection can be made reliably with a simple structure and with high workability.

The pair of flat-type flexible cable connectors of the present invention may be so arranged that the cable holder is provided, on one end face in the thickness direction thereof, with a stopper on which an end face of the leading end part of the end of the flat-type flexible cable rests.

With this arrangement, when reverse mounting of the flat-type flexible cable on the cable holder is attempted, mounting of the flat-type flexible cable will be prevented by the stopper. Thus this reverse mounting is prevented, and 1-N connection or 1-1 connection can be made reliably.

Accordingly, when the cable holder is provided with a stopper on which the end face of the leading end part of the flat-type flexible cable rests, reverse mounting of the flat-type flexible cable on the cable holder can be prevented by the simple structure, and 1-N connection or 1-1 connection can be made reliably.

The pair of flat-type flexible cable connectors of the present invention may be so arranged that the cable holder is provided with a retaining member which clamps between itself and an end face of the cable holder the leading end part or the root end part of the end of the flat-type flexible cable.

With this arrangement, retention of the end of the flat-type flexible cable by the first connector is enhanced.

Accordingly, when the cable holder is provided with the retaining member, retention of the end of the flat-type flexible cable by the first connector can be enhanced.

A harness of flat-type flexible cable of the present invention is a harness of flat-type flexible cable comprising a flat-type flexible cable comprising a plurality of conductors laid side by side in a flat-type insulating coating and having an end in which the insulating coating being removed except a leading end part to expose the conductors; and the first connectors of the pair of flat-type flexible cable connectors of the present invention, the first connectors being mounted on both the ends of the flat-type flexible cable; and the two ends being inverted on the same side.

1-N connection is realized by this harness and the second connector of the pair of flat-type flexible cable connectors of the present invention.

Accordingly, a harness of flat-type flexible cable for 1-N connection using the first connector of the pair of flat-type flexible cable connectors of the present invention was successfully disclosed.

Another harness of flat-type flexible cable of the present invention is a harness of flat-type flexible cable comprising a flat-type flexible cable comprising a plurality of conductors laid side by side in a flat-type insulating coating and having an end in which the insulating coating being removed except a leading end part to expose the conductors; and the first connectors of the pair of flat-type flexible cable connectors as claimed in claim 1, the first connectors being mounted on both the ends of the flat-type flexible cable; and the two ends being inverted on the mutually-opposite sides.

1-1 connection is realized by this harness and the second connector of a pair of flat-type flexible cable connectors of the present invention.

Accordingly, a harness of flat-type flexible cable for 1-1 connection using the first connector of a pair of flat-type flexible cable connectors of the present invention was successfully disclosed.

DETAILED DESCRIPTION OF THE INVENTION

Figure 1:
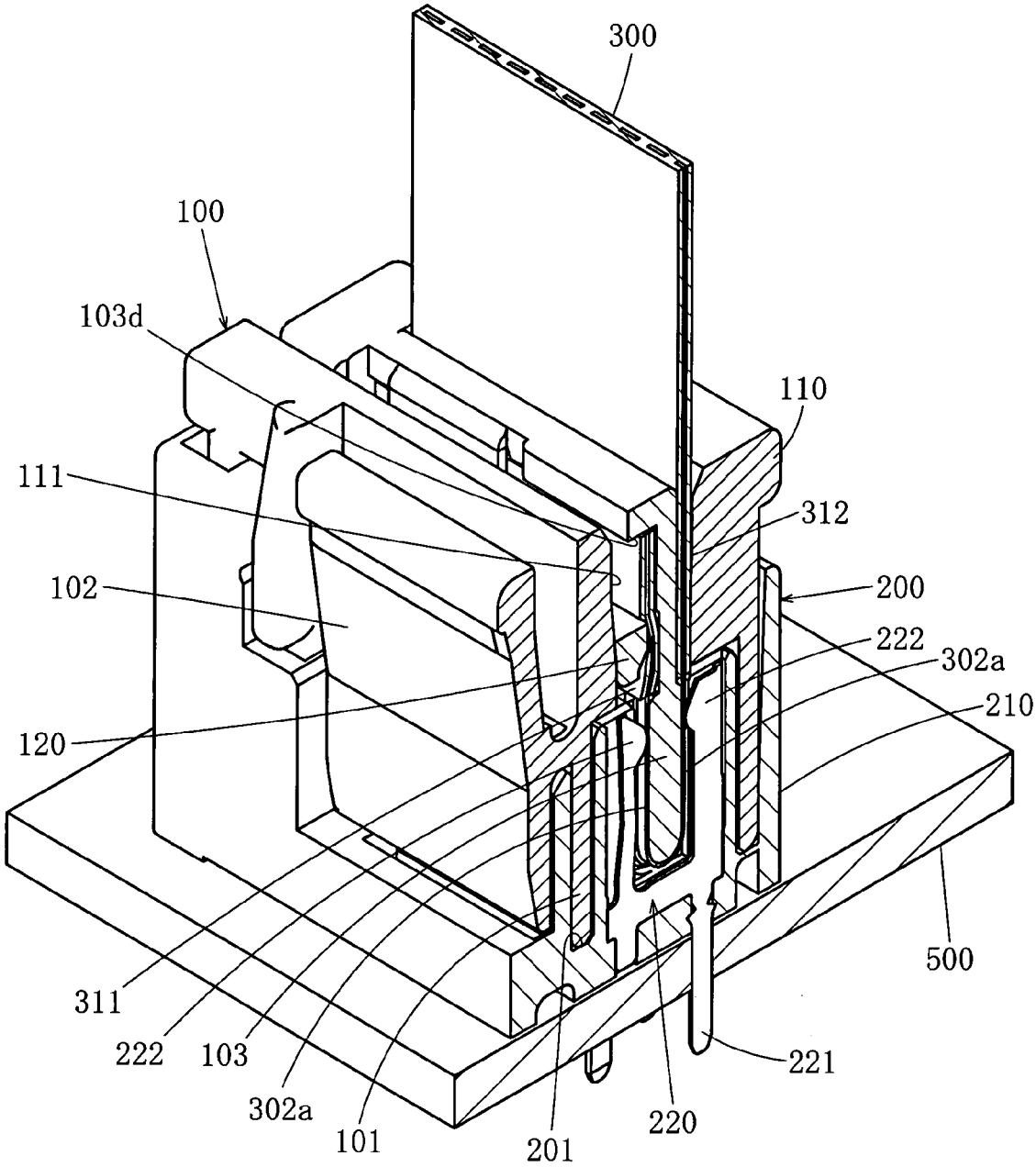
FIG. 1 is a perspective view of a pair of flat-type flexible cable connectors of an embodiment. They are sectioned in a plane facing in the width direction. A first connector is connected to a flat-type flexible cable, and a second connector is mounted on a printed wiring board.
Figure 2:
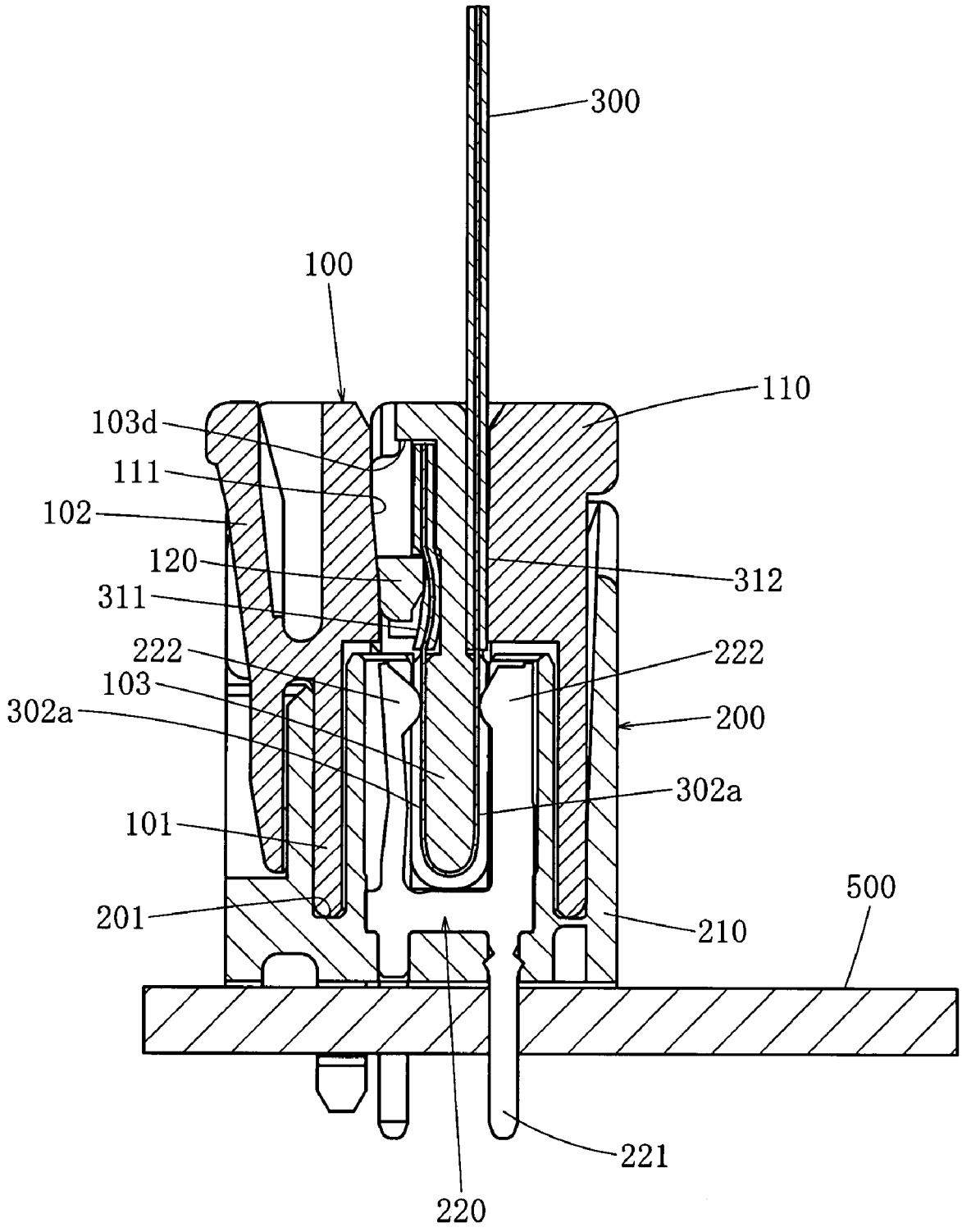
FIG. 2 is a sectional view of the pair of flat-type flexible cable connectors of FIG. 1 seen in the width direction.

In the following, one embodiment of the present invention will be described. FIG. 1 and FIG. 2 illustrate a first connector 100 and a second connector 200 being a pair of flat-type flexible cable connectors of the embodiment. These connectors 100, 200 connect a flat-type flexible cable 300 to a printed wiring board 500 being a member of connection target. This member of connection target may be a member other than a printed wiring board, and is not limited by this embodiment. For convenience of description, a depth direction, a width direction and a thickness direction all being perpendicular to each other are assumed. In the case of this embodiment, with reference to FIG. 2 for explanation, the top-bottom direction of the diagram is the depth direction, the direction perpendicular to the plane of the diagram is the width direction, and the left-right direction of the diagram is the thickness direction.

Figure 3:
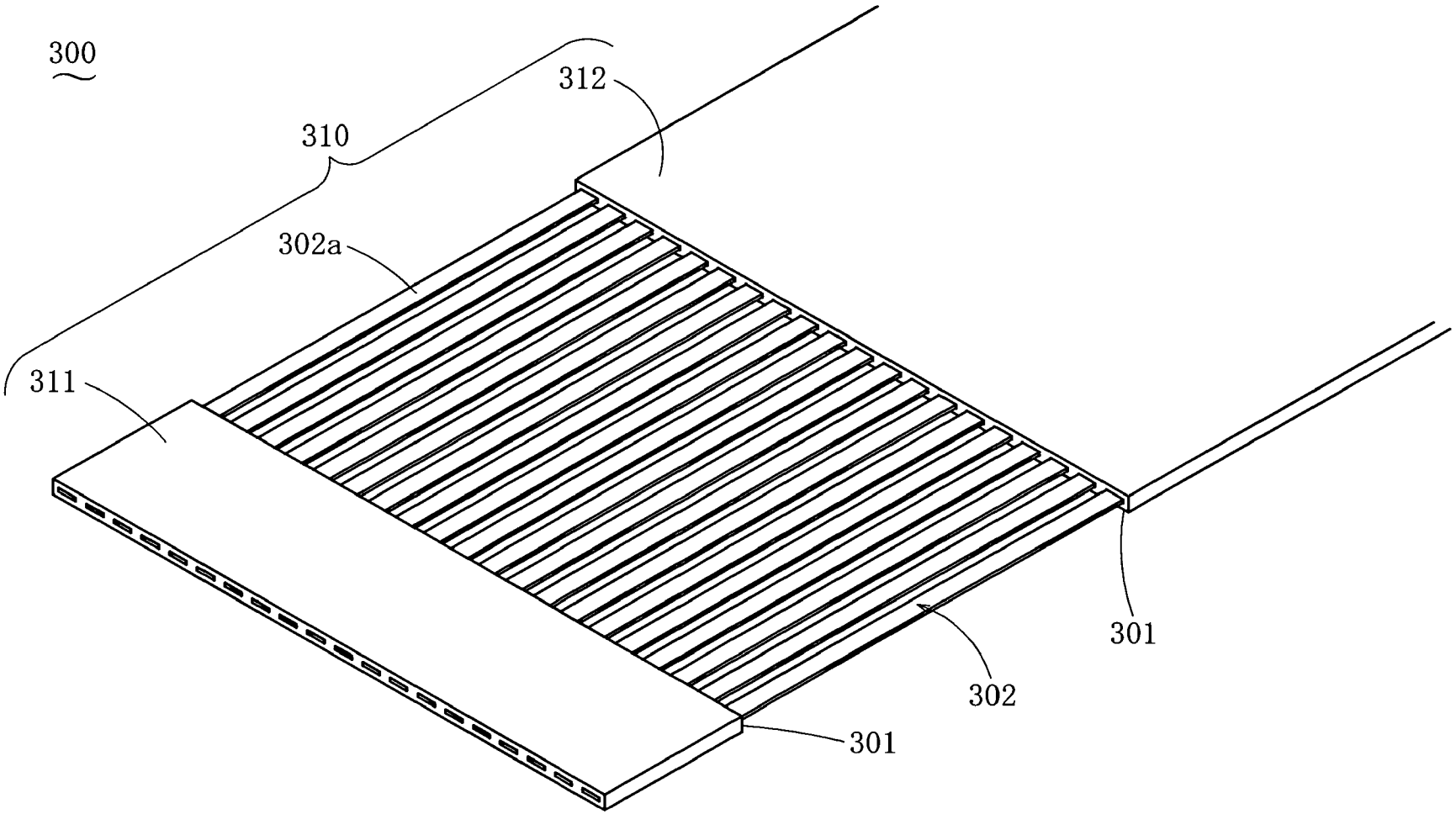
FIG. 3 is a perspective view of the flat-type flexible cable of the embodiment around one end part thereof. An insulating coating of the end part is removed to expose conductors except a leading end part.

The flat-type flexible cable 300 of this embodiment is an FFC. As illustrated in FIG. 3, this flat-type flexible cable 300 comprises a flat-type insulating coating 301 and a plurality of conductors 302 provided in the insulating coating 301. The conductors 302 are laid side-by-side with spacing between them. The insulating coating 301 is a planar insulator having flexibility, and the conductors 302 are held in a part of an intermediate layer of the insulating coating 301. The flat-type flexible cable being covered by the present invention must not be construed limitedly by the flat-type flexible cable 300 used in the embodiment. The flat-type flexible cable being covered by the present invention includes FFCs wherein conductors are provided on one face of the insulating coating and FPCs (flexible printed circuits).

As illustrated in FIG. 3, in the end 310 of the flat-type flexible cable 300, the insulating coating 301 is removed except a leading end part 311 to expose the conductors 302. This end 310 extends, when the flat-type flexible cable 300 is cut by a cut plane being substantially perpendicular to the extending direction of the conductors 302, from said cut plane in said direction up to a location of a given distance. The leading end part 311 extends, in the end 310, from said cut plane to a location of a distance shorter than said given distance in said direction. From the end face of the leading end part 311 opposite to said cut plane to a location distant by a length shorter than said given length in the extending direction of the conductors 302, there is no insulating coating 301 around the conductors 302, and the conductors 302 are exposed completely. These exposed portions of the conductors 302 are called exposed conductors 302*a*. The insulating coating 301 may remain between a conductor 302 and a conductor 302. In this embodiment, the conductors 302 are exposed by stripping the flat-type flexible cable 300, and the leading end part 311 keeps the insulating coating 301 intact. In the end 310, there exists a root end part 312 opposite to the leading end part 311 with the exposed conductors 302*a* in between them.

Figure 4:
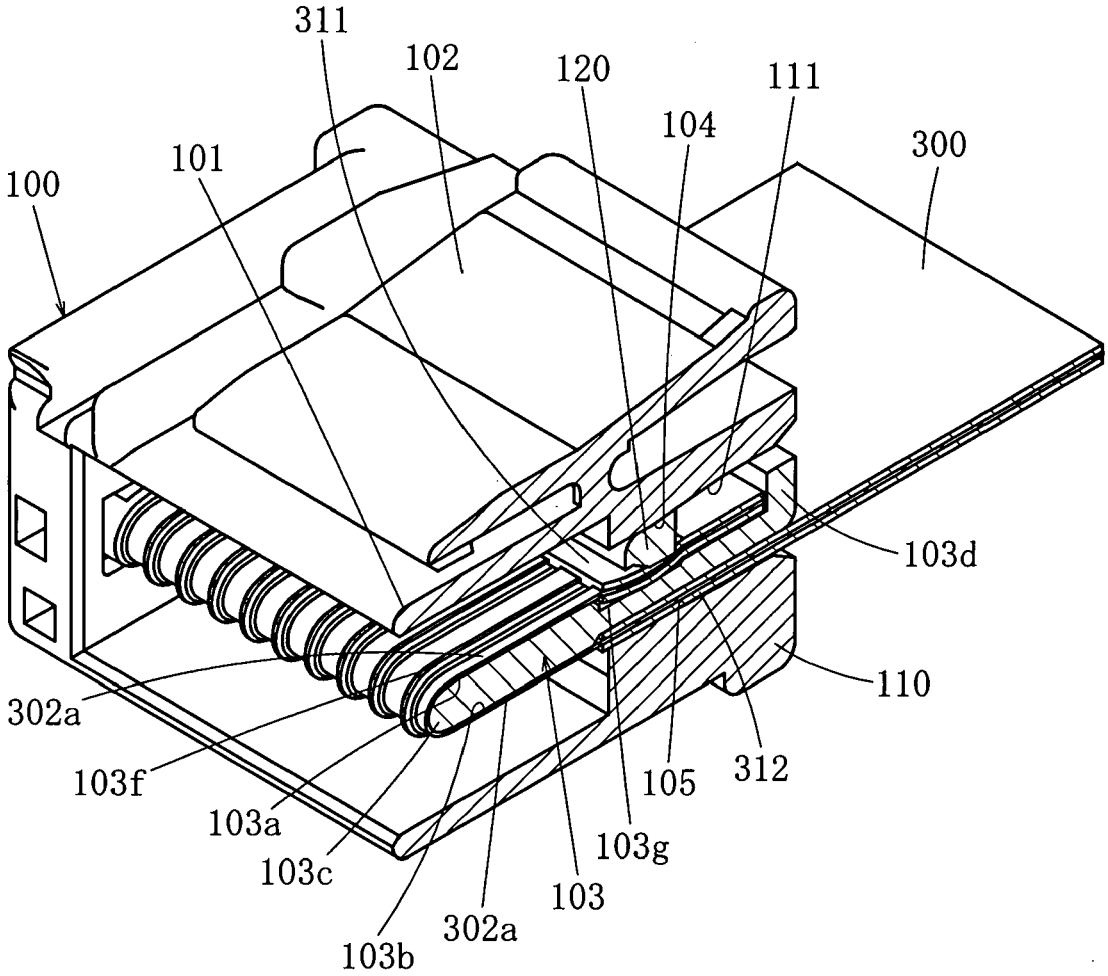
FIG. 4 is a perspective view of the first connector of the embodiment, which is connected to the flat-type flexible cable. They are sectioned in a plane facing in the width direction.
Figure 5:
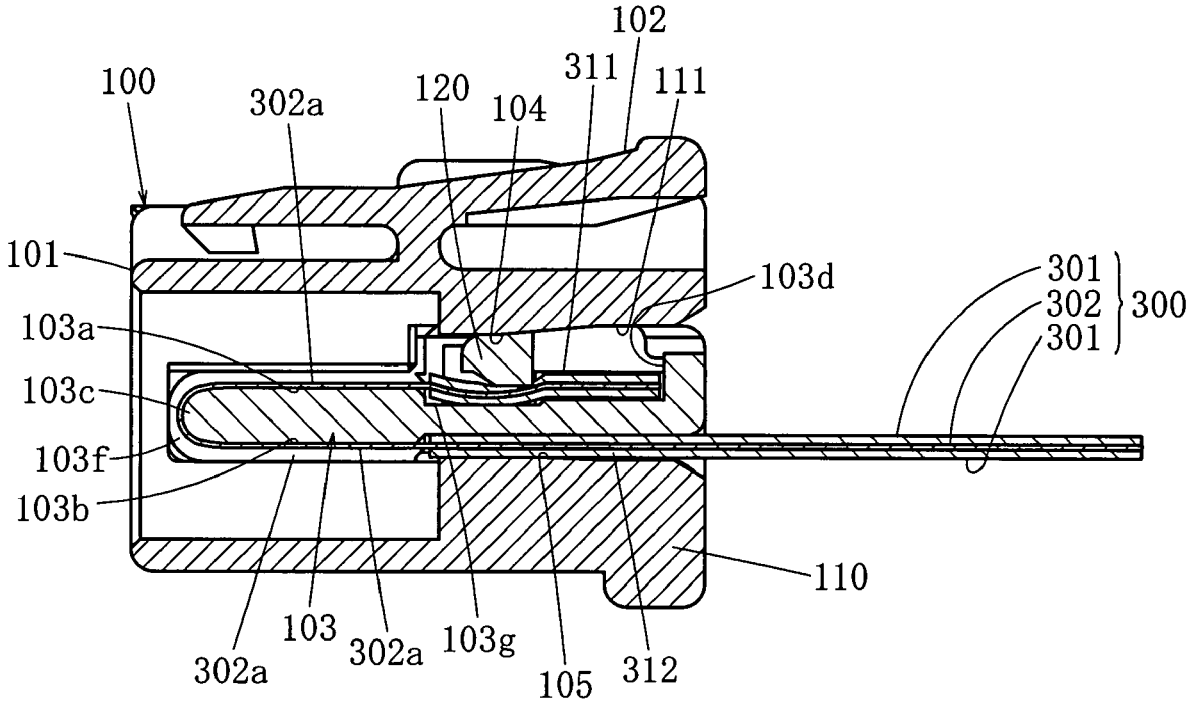
FIG. 5 is a sectional view of the first connector of FIG. 4 seen in the width direction.

As illustrated in FIG. 4 and FIG. 5, the first connector 100 is formed of an insulating material, and is connected to the end 310 of the flat-type flexible cable 300. In this case, the first connector 100 is so oriented that its width direction aligns with the direction in which the conductors 302 are laid side by side in the flat-type flexible cable 300. As illustrated in FIG. 1 and FIG. 2, the second connector 200 is fitted with the first connector 100 by inserting the first connector 100 in the counterpart in the depth direction, and after that, the second connector 200 is disconnected from the first connector 100 by withdrawing the second connector 200 in the depth direction. In the case of this embodiment, a convex part 101 is provided on one end in the depth direction of the first connector 100, and a concave part 201 is provided on one end in the depth direction of the second connector 200; both the connectors 100, 200 are fitted up by inserting the convex part 101 of the first connector 100 into the concave part 201 of the second connector 200, and both the connectors 100, 200 are disconnected from each other by withdrawing the convex part 101 from the concave part 201. As to the fitting-up structure of both the connectors, conversely, a concave part may be provided on the first connector and a convex part may be provided on the second connector, or another fitting-up structure of a well-known construction may be used. Moreover, a well-known lock arm 102 is provided on one end in the thickness direction of the first connector 100; said lock arm extends in the depth direction, an intermediate part thereof is fixed onto the first connector 100 by a flexible part, said lock arm is provided with a hook on an end on the side of fitting with the second connector 200, and the other end thereof serves as an operating part. And on one end in the thickness direction of the second connector 200, a well-known locked part 202 being a through hole in which the hook of the lock arm 102 will be caught is provided. The locked part may be a hole, a claw, etc. Conversely, a locked part may be provided on the first connector and a lock arm may be provided on the second connector, or another locking structure of a well-known construction may be used. Or a locking structure may be omitted.

The first connector 100 is provided with a plate-like cable holder 103 having flat end faces 103*a*, 103*b* on both sides in the thickness direction. These end faces 103*a*, 103*b* are made substantially parallel to each other, however, they may be arranged otherwise. One end 103*c* in the depth direction of the cable holder 103 protrudes into the side on which the cable holder 103 fits with the second connector 200. As illustrated in FIG. 1, FIG. 2, FIG. 4 and FIG. 5, the end 310 of the flat-type flexible cable 300 is inverted by bending an intermediate part of the exposed conductors 302*a* in an approximately-U-shape, and is connected to the first connector 100 in this form. Then, the cable holder 103 makes the end 310 in the inverted form of the flat-type flexible cable 300 extend and contact both said end faces 103*a*, 103*b* with the bent part of the exposed conductors 302*a* serving as a boundary. In other words, the bent part of the exposed conductors 302*a* contacts one end 103*c* of the cable holder 103, the leading end part 311 and the part of the leading end part side of the exposed conductors 302*a* contact the end face 103*a*, and the root end part 312 and the part of the root end part side of the exposed conductors 302*a* contact the end face 103*b*. The bent part of the exposed conductors does not necessarily need to contact one end of the cable holder, and it may be set loose with a small clearance. The first connector 100 is structured to hold the leading end part 311 and the root end part 312 of the end 310 of the flat-type flexible cable 300. Here, the leading end part 311 is clamped by the end face 103*a* of the cable holder 103 and a retaining member 120 to be described later, and the root end part 312 is clamped by the end face 103*b* of the cable holder 103 and a lateral wall 105 of the first connector body 110 that will be described later, and with this, the leading end part 311 and the root end part 312 are held by the first connector 100. Holding of the leading end part and the root end part by the first connector may be done by clamping with other parts, may be done by a well-known locking structure, may be done by adhesion or may be done by other means.

The second connector 200 comprises a second connector body 210 that is made of an insulating material and is capable of fitting with the first connector 100, and a plurality of terminals 220 that are made of a conductive material and are laid side by side in the width direction in the second connector body 210. The terminals 220 are so arranged that when the second connector body 210 fits with the first connector 100, the terminals 220 contact the exposed conductors 302*a* of the end 310 of the flat-type flexible cable 300 respectively. The terminal 220 of this embodiment is of a two-contact-point type, which contacts a counterpart conductor 302 at two points. This terminal 220 comprises a connecting part 221 that is provided on the second connector body 210, and two contacting parts 222 that extend from the connecting part 221 in the depth direction and have a contact point near a top end thereof, and is so arranged that one contact point contacts a portion of the counterpart exposed conductor 302*a* that contacts one end face 103*a* of the cable holder 103, and the other contact point contacts a portion of the counterpart exposed conductor 302*a* that contacts the other end face 103*b* of the cable holder 103. However, the terminal may be of a single-contact-point type that contacts either one portion of the counter conductor.

The fitting parts of the first connector 100 and the second connector 200 are made asymmetrical in the thickness direction. In other words, these fitting parts are not symmetrical in relation to faces perpendicular to the thickness direction. Here, the convex part 101 of the first connector 100 and the concave part 201 of the second connector 200 are provided asymmetrical in the thickness direction. With this arrangement, reverse fitting, namely, fitting the first connector 100 with the second connector 200 the other way around in the thickness direction, is prevented.

The first connector 100 is structured to prevent reverse connection, namely, connecting the inverted end 310 of the flat-type flexible cable 300 to the first connector 100 the other way around in the thickness direction. The specific structure for this purpose will be explained. The first connector 100 is divided into the first connector body 110 and the cable holder 103 described above. The first connector body 110 is the major part of the first connector 100 and is capable of fitting with the second connector 200. The first connector body 110 is provided with a through hole 111 that penetrates in the depth direction. The cable holder 103 is inserted into the through hole 111 of the first connector body 110 from the side opposite to the side of fitting with the second connector 200 in the depth direction and is fitted with the first connector body 110. When the cable holder 103 is fitted with the first connector body 110, one end 103*c* in the depth direction of the cable holder 103 passes through the through hole 111 and protrudes into the side of fitting with the second connector 200. Fitting of the cable holder 103 with the first connector body 110 is effected by a portion of the cable holder 103 excluding both the end faces 103*a*, 103*b* in the thickness direction. Here, the ends in the width direction of the cable holder 103 are fitted in concave parts provided in vertical walls facing in the width direction on both the ends in the width direction of the walls constituting the through hole 111. As to this fitting structure, conversely, the cable holder may be provided with concave parts and the vertical walls may be provided with convex parts, or another fitting structure of a well-known construction may be used.

The cable holder 103 is structured to prevent reverse mounting, namely, mounting the inverted end 310 of the flat-type flexible cable 300 on the cable holder 103 the other way around in the thickness direction. The specific structure for that purpose is that one end face 103*a* in the thickness direction of the cable holder 103 is provided with a stopper 103*d* on which the end face of the leading end part 311 of the end 310 of the flat-type flexible cable 300 rests. With this structure, of the end 310, if an attempt is made inadvertently to make the root end part 312 and the part on the root end part side of the exposed conductors 302*a* contact not the end face 103*b* being the proper one to be contacted but the end face 103*a*, a part of the flat-type flexible cable 300 extending from the root end part 312 will ride on the stopper 103*d* protruding from the end face 103*a* to swell, and it will become difficult to insert the cable holder 103 into the through hole 111 of the first connector body 110. Thus, the reverse mounting is prevented. Moreover, as the end face of the leading end part 311 rests on the stopper 103*d*, positioning of the end 310 in the depth direction of the cable holder 103 is done with high precision, and the exposed conductors 302*a* are accurately positioned at the target location on the end 103*c* of the cable holder 103.

Figure 7:
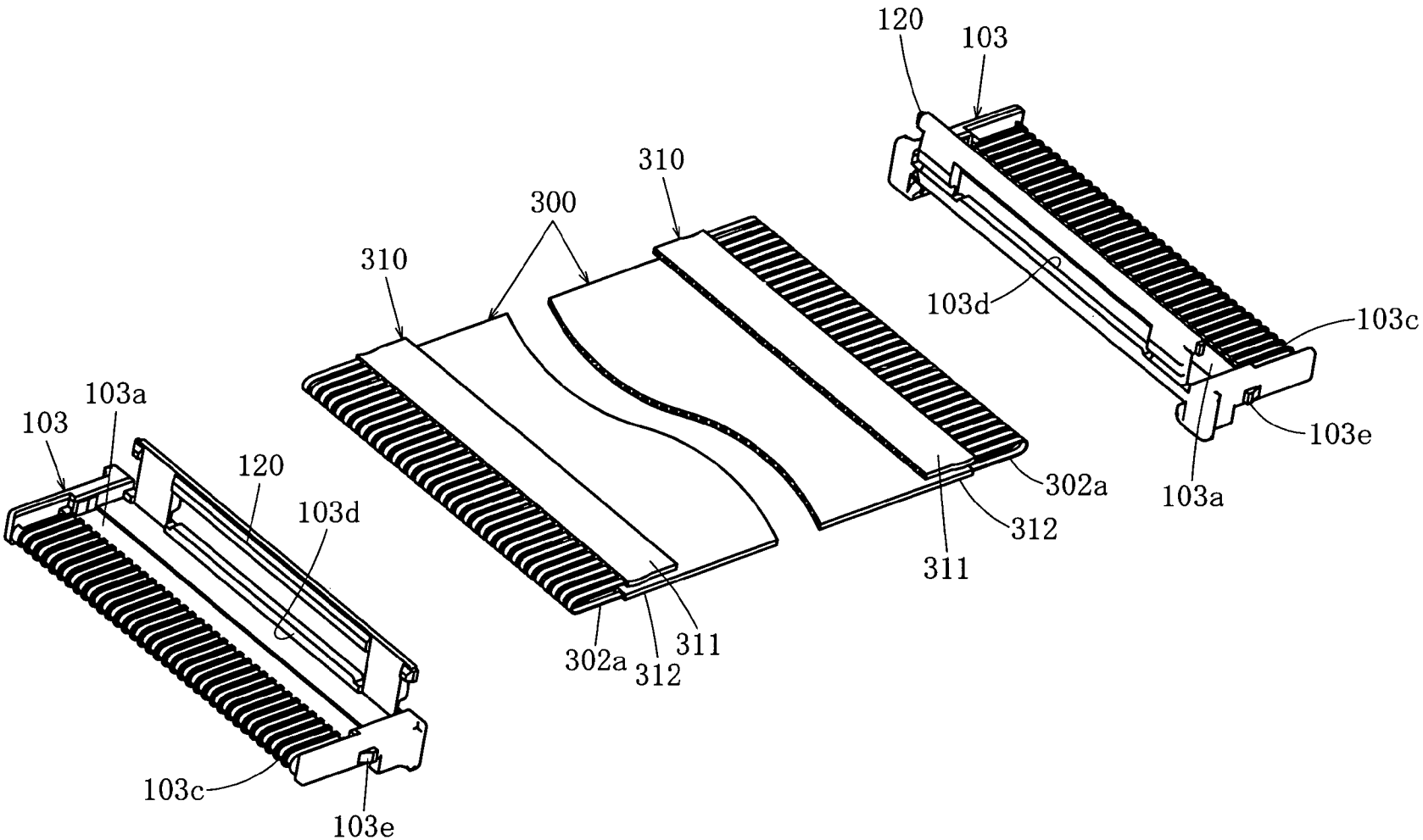
FIG. 7 is a reduced perspective view illustrating the flat-type flexible cable of FIG. 6 and cable holders of the embodiment when the cable holders are arranged to oppose to both the ends of the flat-type flexible cable respectively.

Moreover, the fitting parts of the cable holder 103 and the first connector body 110 are made asymmetrical in the thickness direction. Namely, these fitting parts are not symmetrical in relation to faces perpendicular to the thickness direction. With this arrangement, reverse fitting, namely, fitting the cable holder 103 into the first connector body 110 the other way around in the thickness direction, is prevented. Here, as illustrated in FIG. 7, a protrusion 103*e* is provided on an end in the width direction of the cable holder 103, and this protrusion 103*e* is made to fit into a hole (not illustrated) provided in said vertical wall of the first connector body 110 to fit them together, and this protrusion 103 is shifted away from the center in the thickness direction of the cable holder 103 and said hole is shifted away from the center in the thickness direction of the first connector body 110 to prevent reverse fitting. As to the fitting structure of the cable holder and the first connector body, conversely, a hole may be provided in the cable holder and a protruding part may be provided on the first connector body, or another fitting structure of a well-known construction may be used. 103*f* is a partitioning wall rising from the end faces 103*a*, 103*b* of the cable holder 103 in the thickness direction, and rising from the end 103*c* of the cable holder 103 in the depth direction. The partitioning walls 103*f* are laid side by side in the width direction with the same intervals as those of the conductors 302 of the flat-type flexible cable 300, and the respective partitioning walls 103*f* part neighboring exposed conductors 302*a* on both sides in the width direction to prevent these exposed conductors 302*a* from contacting each other.

The cable holder 103 is provided with a retaining member 120 on one side in the thickness direction thereof. This retaining member 120 can vary its clearance from the end face 103*a* in the thickness direction of the cable holder 103. Here, as illustrated in FIG. 7, the retaining member 120 is enabled to change its position in the thickness direction by setting one end in the depth direction of each end in the width direction of the retaining member 120 rotatably on the cable holder 103, and with this arrangement, the clearance between the retaining member 120 and the end face 103*a* is made changeable. The retaining member 120 is pressed by a lateral wall 104 facing in the thickness direction and being one of the walls constituting the through hole 111 of the first connector body 110. The leading end part 311 of the end 310 of the flat-type flexible cable 300 is clamped between the retaining member 120 being pressed by the lateral wall 104 and the end face 103*a* of the cable holder 103. As illustrated in FIG. 5, at least one of the lateral wall 104 of the first connector body 110 and the lateral wall 105 opposing to the lateral wall 104 in the thickness direction is provided slantwise, and the dimension in the thickness direction of the through hole 111 is made to decrease towards the side of fitting with the second connector 200. With this arrangement, when the cable holder 103 with the end 310 of the flat-type flexible cable 300 being mounted thereon is inserted towards the side of fitting with the second connector 200, the pressing force being exerted by the lateral wall 104 on the retaining member 120 will increase gradually and, in turn, the forces of clamping the leading end part 311 and the root end part 312 will increase. The end face 103*a* of the cable holder 103 is provided with a receiving part 103*g* being concaved in the thickness direction at a location opposing to the retaining member 120, and the receiving part 103*g* receives the leading end part 311 being pressed by the retaining member 120 to allow it to bend, and this in turn makes the leading end part 311 hard to slip off in the depth direction. Such a slant may be omitted, and such a receiving part may be omitted. In this embodiment, the leading end part 311 of the end 310 is clamped by the retaining member 120 and the end face 103*a*, but a retaining member may be provided on the cable holder on the side opposite to the above-mentioned one, and the root end part of the end may be clamped by the latter retaining member and the opposite end face. Moreover, retaining members may be provided on both sides of the cable holder, and both the leading end part and the root end part of the end may be clamped by the retaining members and the end faces. The present invention includes embodiments wherein no retaining member is provided.

The leading end part 311 at the end 310 of the flat-type flexible cable 300 is clamped by the retaining member 120 under the pressing force of the lateral wall 104 of the first connector body 110, and the end face 103*a* of the cable holder 103. Moreover, the root end part 312 of the end 310 of the flat-type flexible cable 300 is clamped by the lateral wall 105 of the first connector body 110, and the end face 103*b* of the cable holder 103.

Next, actions of the above-mentioned embodiment will be described. The inverted end 310 of the flat-type flexible cable 300 is made to extend and contact both the end faces 103*a*, 103*b* in the thickness direction of the cable holder 103 of the first connector 100, with the bent part of the exposed conductors 302*a* serving as a boundary, and the leading end part 311 and the root end part 312 of the end 310 are held by the first connector 100. When the first connector 100 and the second connector 200 are fitted together, the terminals 220 will contact the exposed conductors 302*a* of the end 310 respectively.

Figure 6:
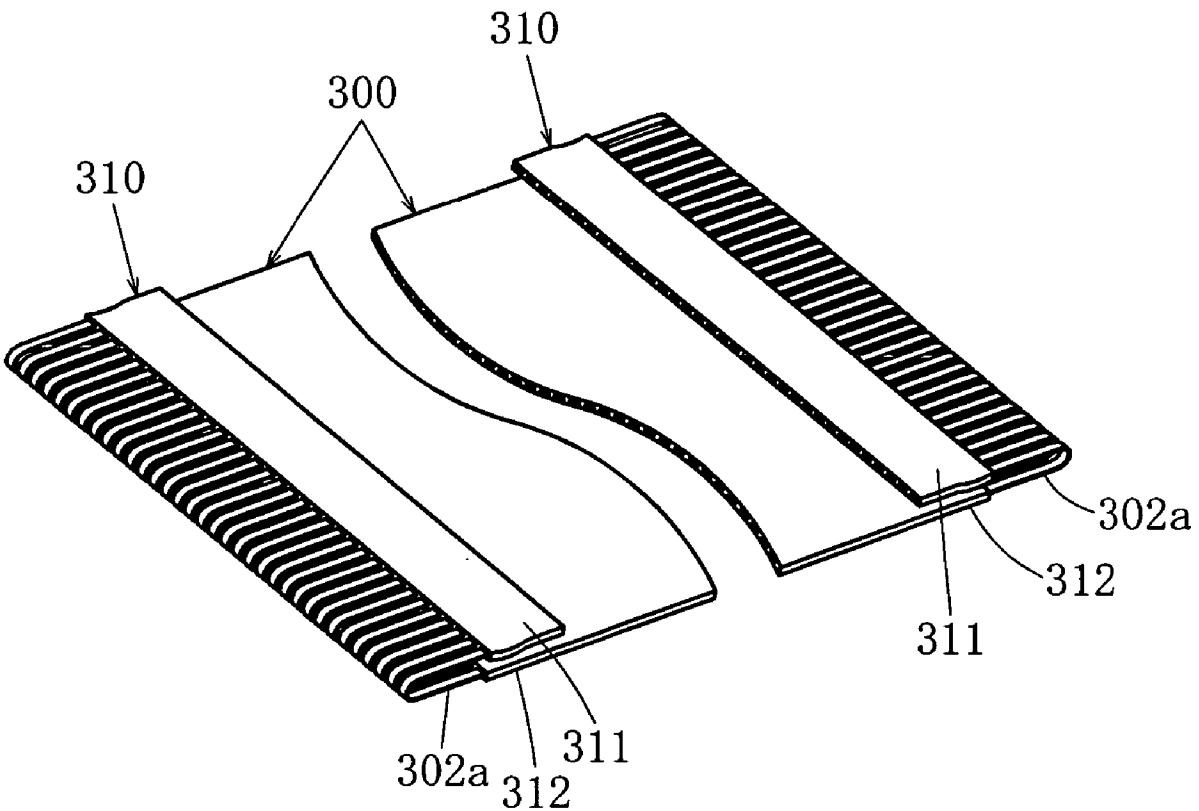
FIG. 6 is a reduced perspective view illustrating the flat-type flexible cable of the embodiment when both end parts thereof are inverted to make 1-N connection. An intermediate part in the longitudinal direction of the flat-type flexible cable is omitted in illustration.
Figure 8:
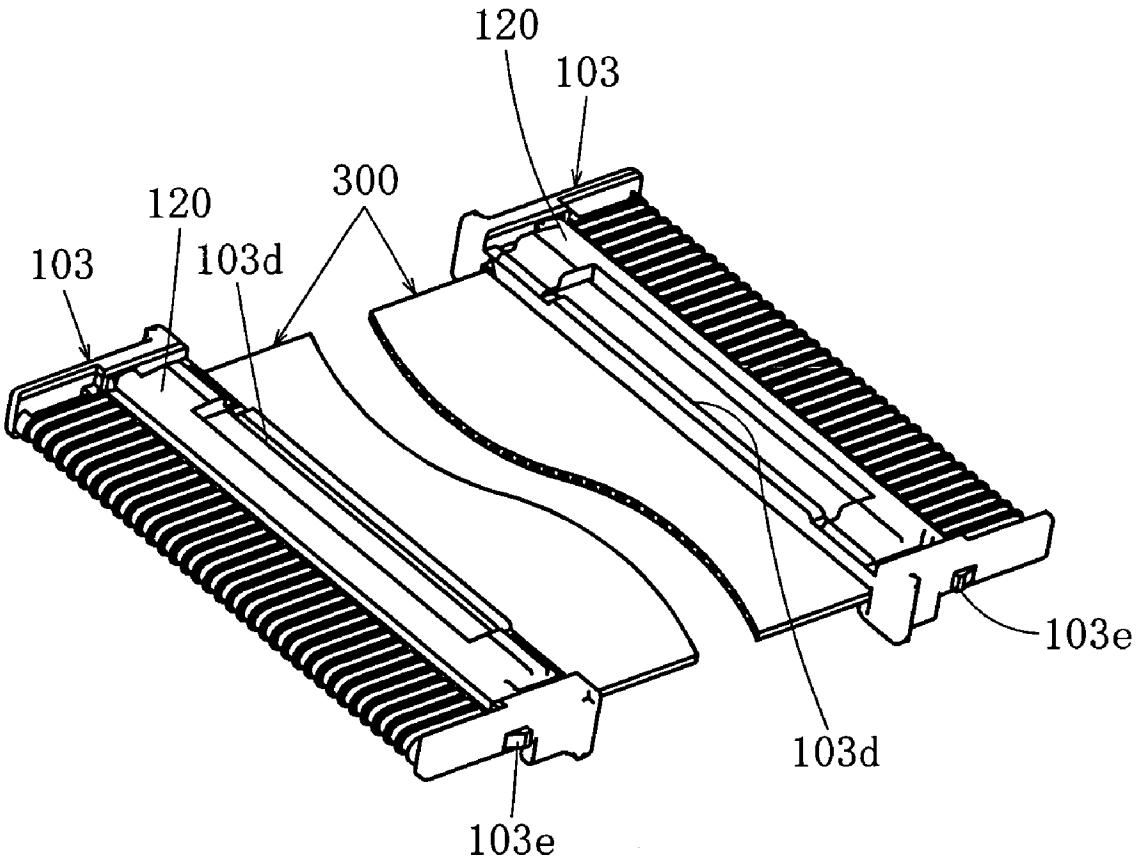
FIG. 8 is a reduced perspective view illustrating the flat-type flexible cable and cable holders of FIG. 7 when both the ends of the flat-type flexible cable are mounted on the cable holders respectively.
Figure 9:
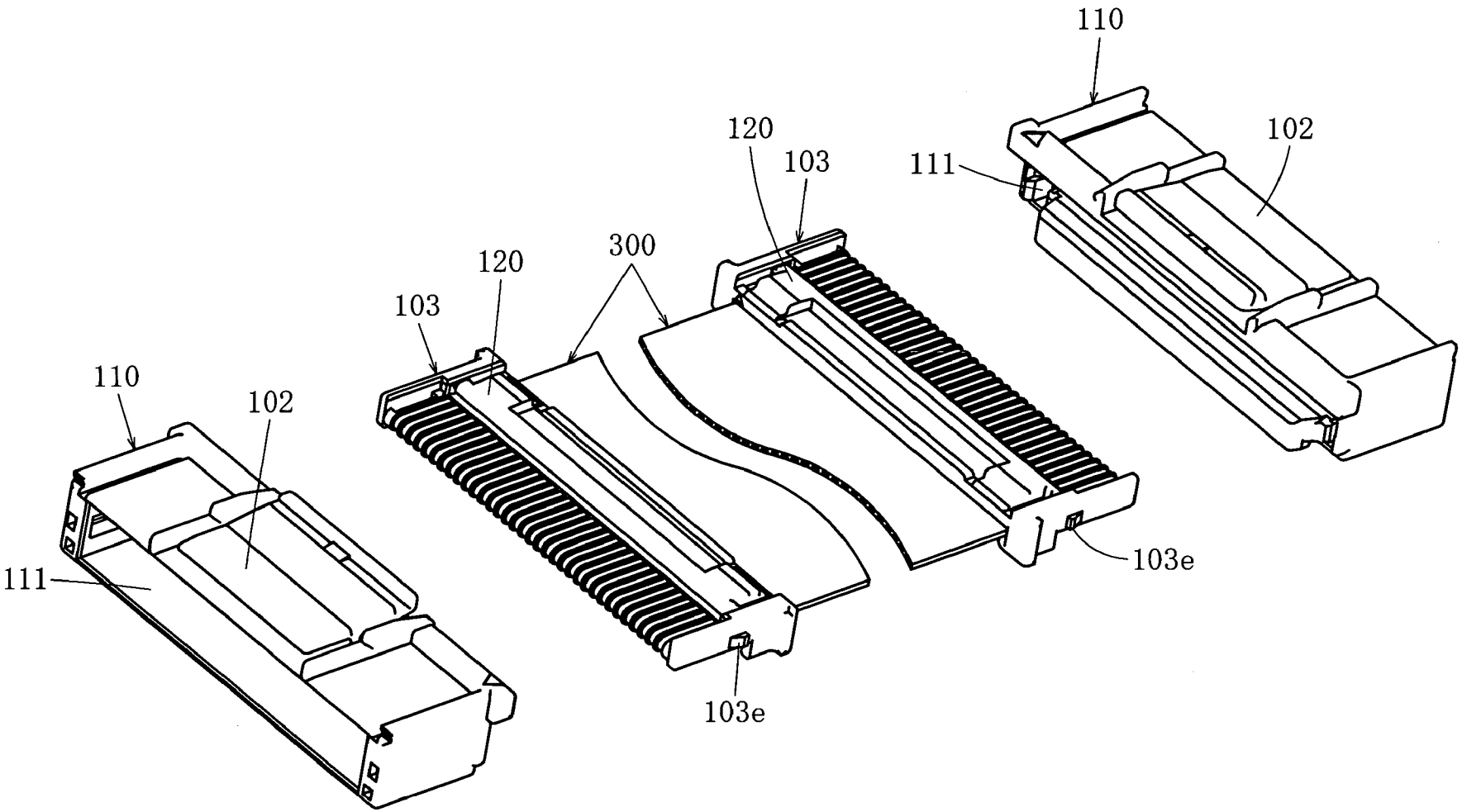
FIG. 9 is a reduced perspective view illustrating the flat-type flexible cable with cable holders of FIG. 8 and the first connector bodies of the embodiment when the first connector bodies are arranged to oppose to both the cable holders respectively.
Figure 10:
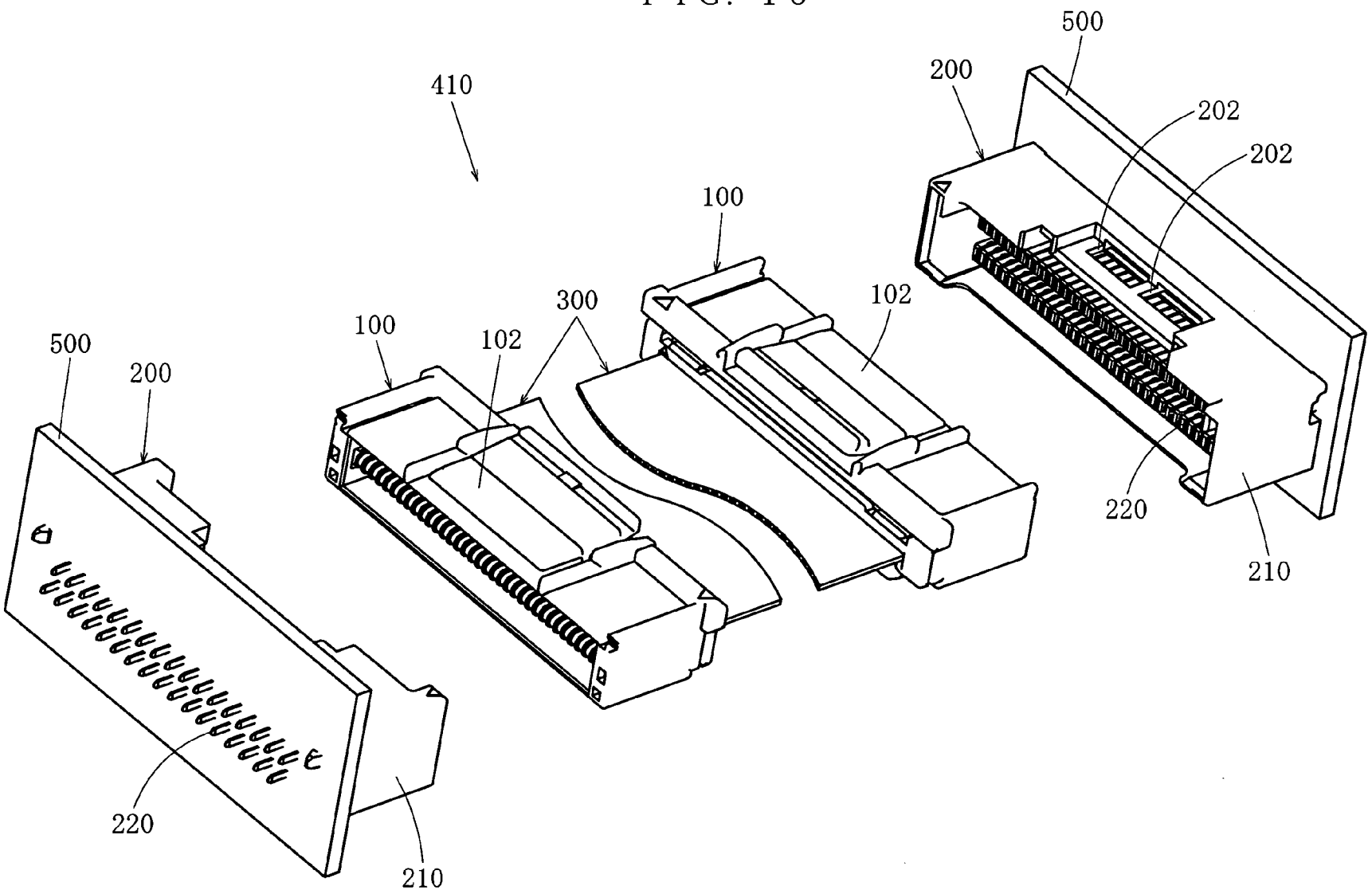
FIG. 10 is a reduced perspective view illustrating the harness and the second connectors of the embodiment when the second connectors are arranged to oppose to both the first connectors of FIG. 9 respectively. The second connectors are mounted on the printed wiring boards of the embodiment.

First, effectuation of 1-N connection with the use of a pair of flat-type flexible cable connectors of the embodiment will be described. For convenience of description, both the end faces in the thickness direction of the flat-type flexible cable 300, the first connector 100 and the second connector 200 are identified as face A and face B. In the flat-type flexible cable 300 illustrated in FIG. 6, a broad face seen at the center is defined as face A. The flat-type flexible cable 300 is assumed to be free of any twist. As illustrated on the left side of the diagram, the insulating coating 301 of one end 310 of the flat-type flexible cable 300 is removed except the leading end part 311 to expose the conductors 302. Then an intermediate part of the exposed conductors 302*a* is bent in an approximately-U-shape so that the leading end part 311 comes closer to the face A of the flat-type flexible cable 300; this inverts the end 310 of the flat-type flexible cable 300. In FIG. 6, as the end 310 is inverted, the face B is shown slightly. The first connector 100 is to be connected to this end 310. To be more specific, as illustrated on the left side of FIG. 7, the retaining member 120 of the cable holder 103 is kept apart from the end face 103*a*, then, as illustrated on the left side of FIG. 8, the end 310 is mounted on the cable holder 103 so that the end face of the leading end part 311 of the inverted end 310 comes to rest on the stopper 103*d*, then the retaining member 120 is set on the leading end part 311 contacting the end face 103*a*. Next, as illustrated on the left side of FIG. 9, the cable holder 103 is made to oppose to the first connector body 110, and as illustrated on the left side of FIG. 10, the cable holder 103 is fitted with the first connector body 110 to complete the first connector 100. Of the two end faces in the thickness direction of the first connector 100, one end face that eventually comes to the same side as the face A of the flat-type flexible cable is defined as the face A. In the case of this embodiment, the end face that is provided with the lock arm 102 is the face A. Then, the first connector 100 is connected to the second connector 200 mounted on the printed wiring board 500. As a result, as illustrated on the left side of FIG. 10, of the two end faces in the thickness direction of the second connector 200, one end face that eventually comes to the same side as the face A of the flat-type flexible cable 300 is defined as the face A. In the case of this embodiment, the end face that is provided with the locked part 202 is the face A. Then, as illustrated on the right side of FIG. 6, the other end 310 of the flat-type flexible cable 300 is connected to the first connector 100 in a connection form similar to that described above. In other words, the insulating coating 301 of the other end 310 of the flat-type flexible cable 300 is removed except the leading end part 311 to expose the conductors 302. Then, an intermediate part of the exposed conductors 302 is bent in an approximately-U-shape so that the leading end part 311 comes closer to the face A of the flat-type flexible cable 300, and in turn, the end 310 of the flat-type flexible cable 300 is inverted. Next, the first connector 100 is connected to this end 310. Then, the first connector 100 is connected to the second connector 200 mounted on the printed wiring board 500. As a result, as illustrated on the right side of FIG. 10, the face A of the flat-type flexible cable 300, the face A of the first connector 100 and the face A of the second connector 200 come to the same side. Thus, with the flat-type flexible cable 300 extending straight in between, two first connectors 100 are opposed to each other in the same position, and in parallel with this, the second connectors are opposed to each other in the same position. Thus the 1-N connection is realized. As illustrated in FIG. 10, a triangular mark is stamped on one end in the width direction of one end face in the thickness direction of the first connector 100, and a triangular mark is stamped in the same manner on the second connector 200. This triangular mark indicates the position of the Nth pole of the conductors 302 (N in number) or the terminals 220 (N in number) laid side by side in the thickness direction. In this connection form, the triangular marks of the first connector 100 and the second connector 200 of one side are not opposed to the triangular marks of the first connector 100 and the second connector 200 of the other side, and the first poles of the first connector 100 and the second connector 200 of one side connect, via the conductor 302 of the flat-type flexible cable 300, to the Nth poles of the first connector 100 and the second connector 200 of the other side. This shows the connection is the 1-N connection.

Figure 11:
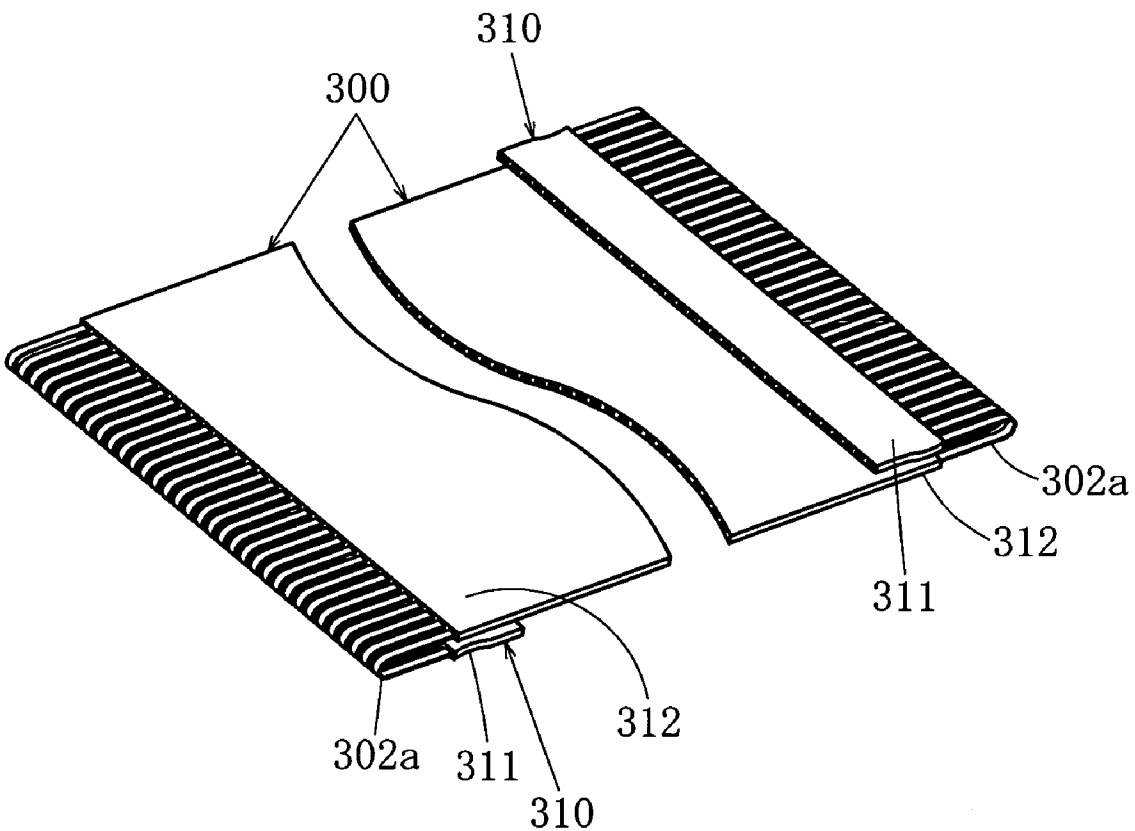
FIG. 11 is a reduced perspective view illustrating the flat-type flexible cable of the embodiment when both the ends thereof are inverted to make 1-1 connection. An intermediate part in the longitudinal direction of the flat-type flexible cable is omitted in illustration.
Figure 12:
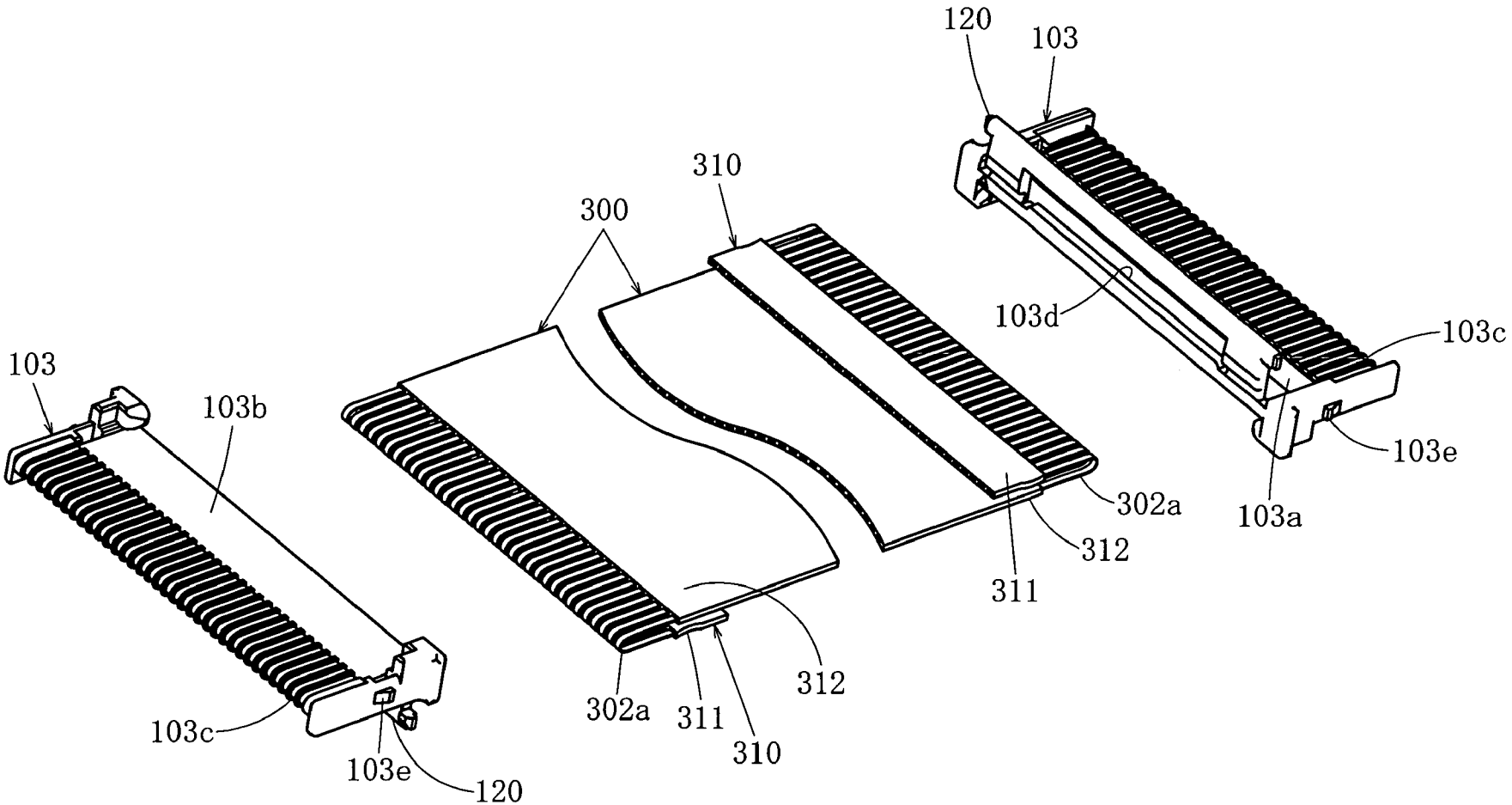
FIG. 12 is a reduced perspective view illustrating the flat-type flexible cable of FIG. 11 and the cable holders of the embodiment when the cable holders are arranged to oppose to both the ends of the flat-type flexible cable respectively.
Figure 13:
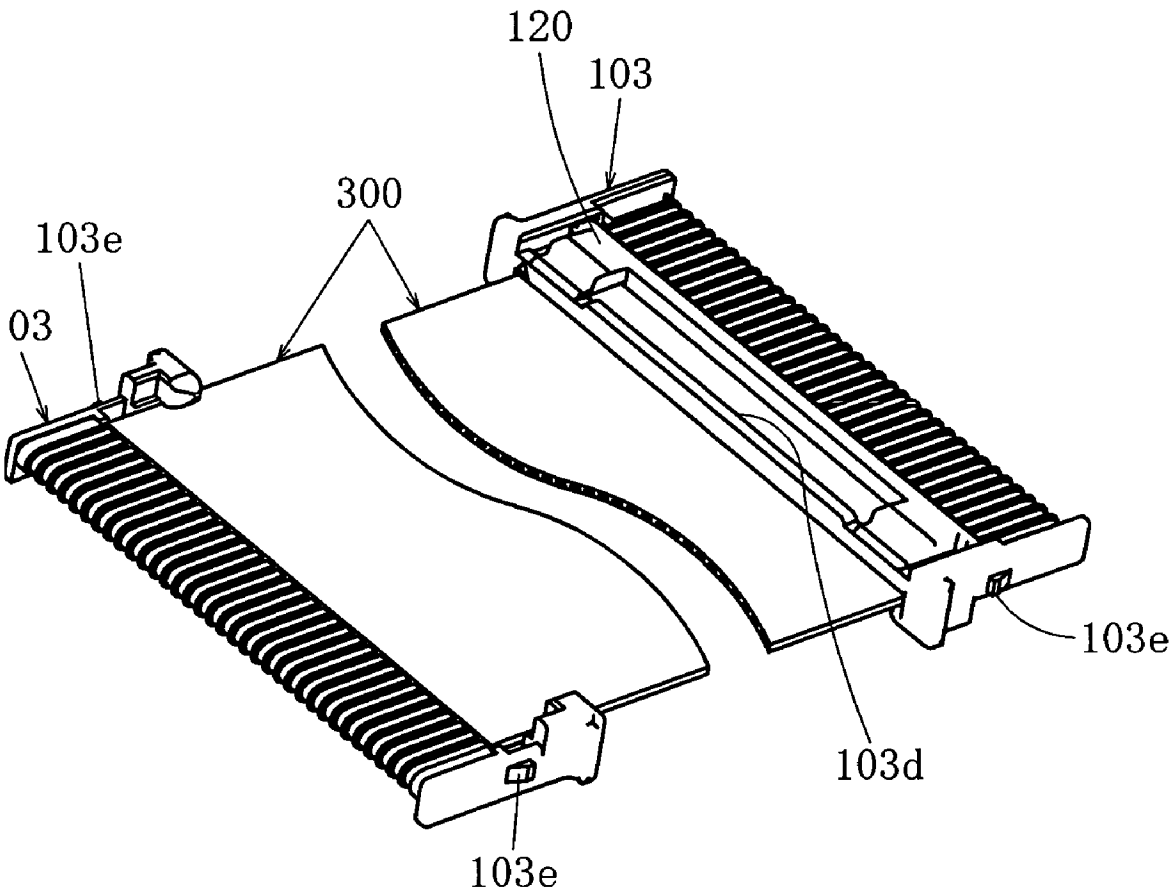
FIG. 13 is a reduced perspective view illustrating the flat-type flexible cable and the cable holders of FIG. 12 when both the ends of the flat-type flexible cable are mounted on the cable holders respectively.
Figure 14:
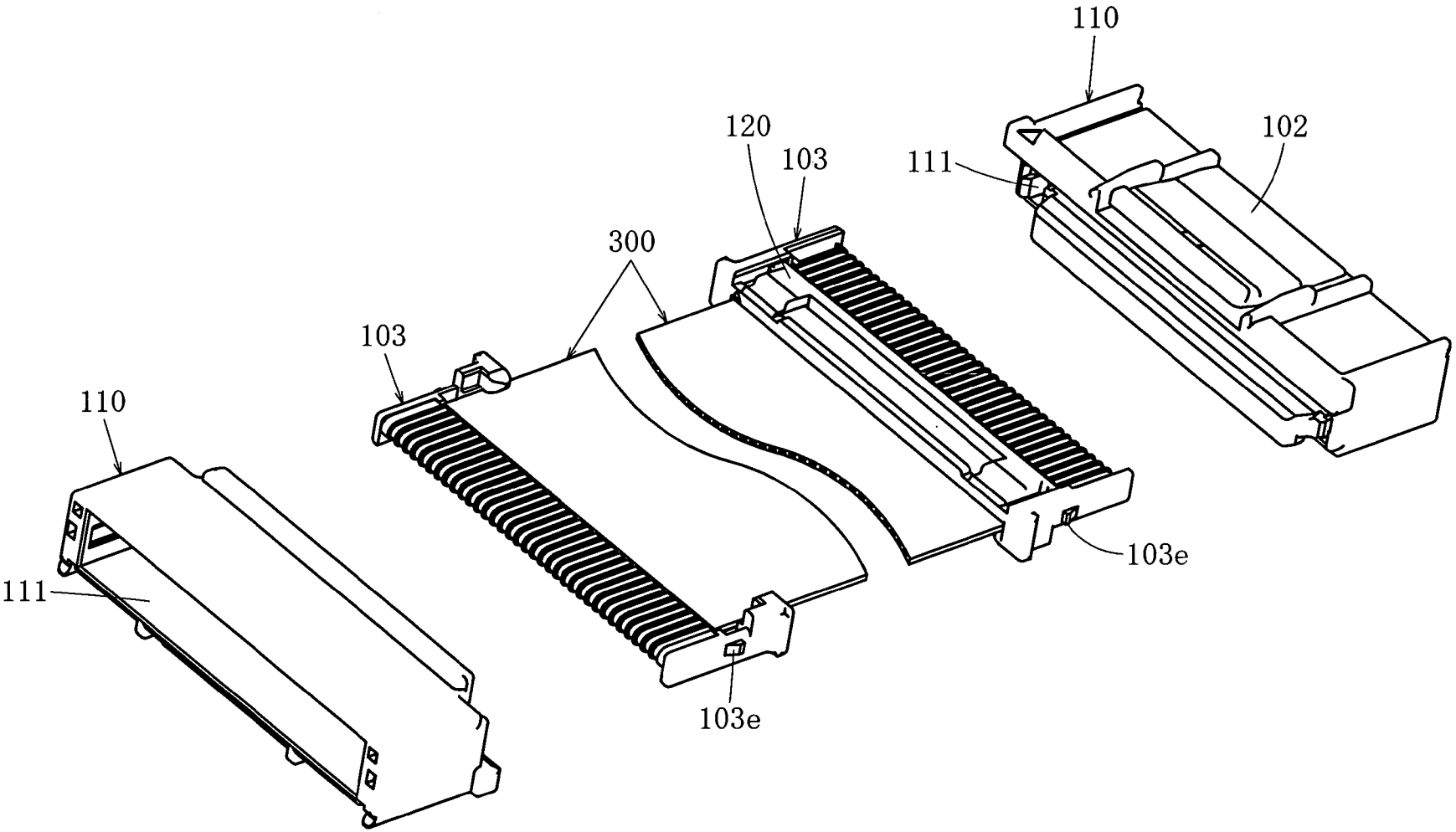
FIG. 14 is a reduced perspective view illustrating the flat-type flexible cable with cable holders of FIG. 13 and the first connector bodies of the embodiment when the first connector bodies are arranged to oppose to both the cable holders respectively.
Figure 15:
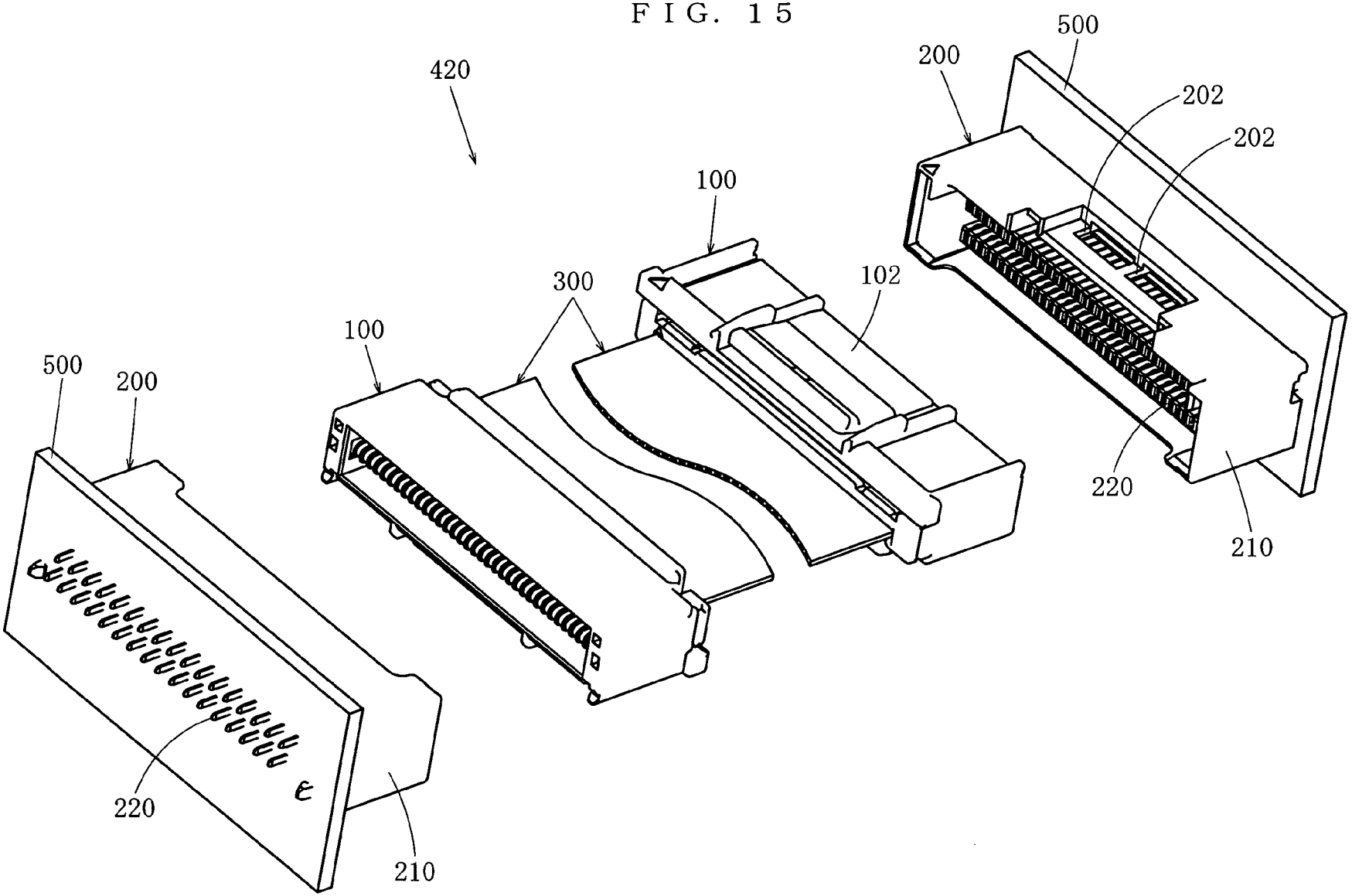
FIG. 15 is a reduced perspective view illustrating the harness and the second connectors of the embodiment when the second connectors are arranged to oppose to both the first connectors of FIG. 14 respectively. The second connectors are mounted on the printed wiring boards of the embodiment.
Figure 16:
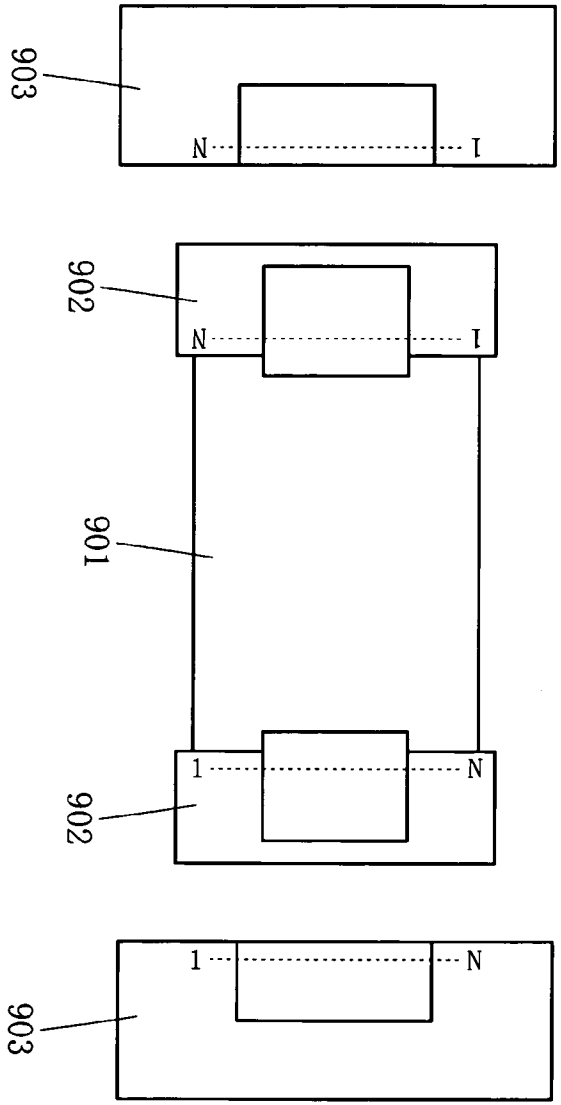
FIG. 16 is a schematic view explaining a conventional harness and conventional connectors that are connected in 1-N connection.
Figure 17:
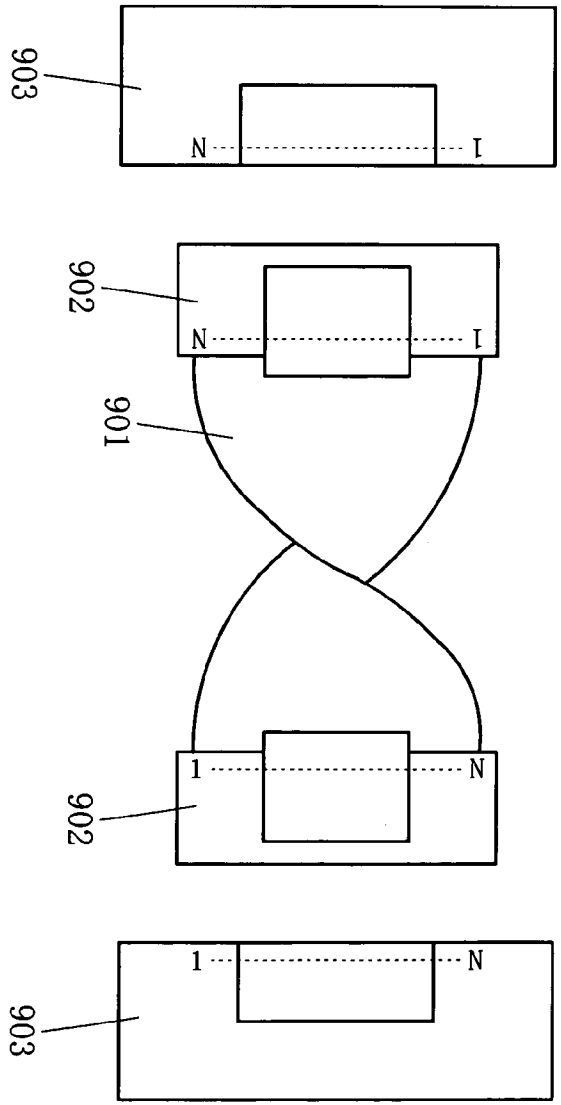
FIG. 17 is a schematic view explaining a conventional harness and conventional connectors that are connected in 1-1 connection.
Figure 18:
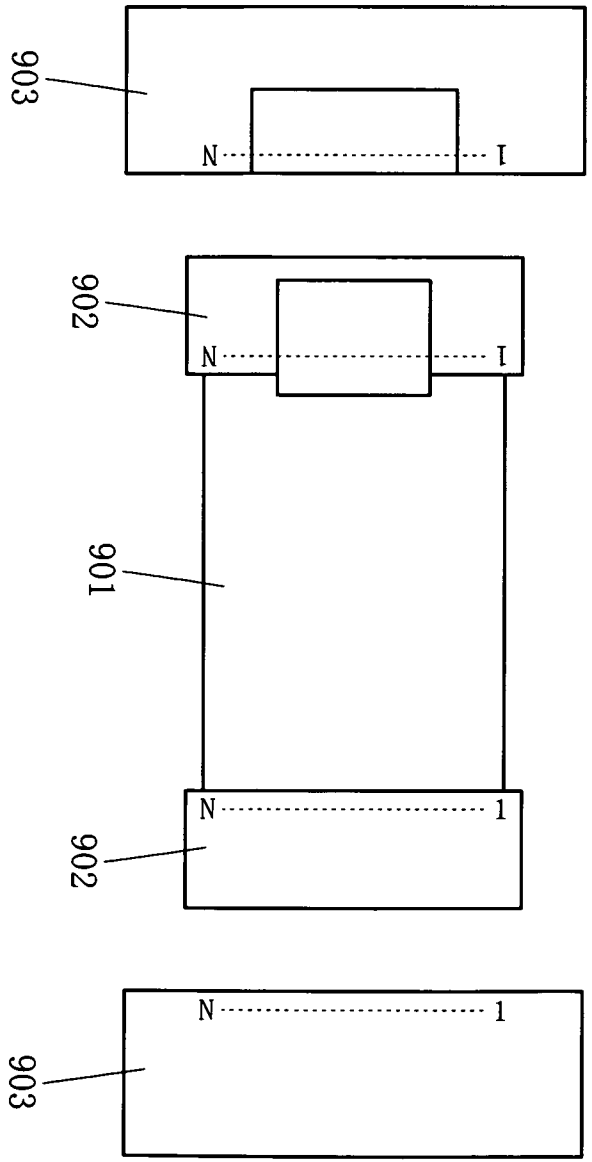
FIG. 18 is a schematic view explaining a conventional harness and conventional connectors that are connected in another way of 1-1 connection.

Next, effectuation of 1-1 connection with the use of a pair of flat-type flexible cable connectors of the embodiment will be described. As to faces A and faces B of the flat-type flexible cable 300, the first connector 100 and the second connector 200, those defined in the above-mentioned description are used, and the flat-type flexible cable 300 is assumed to be free of any twist. In the flat-type flexible cable 300 illustrated in FIG. 11, a broad face seen at the center is the face A. As illustrated on the left side of the diagram, the insulating coating 301 of one end 310 of the flat-type flexible cable 300 is removed except the leading end part 311 to expose the conductors 302. Then, in contrast to the case of the above-mentioned 1-N connection, an intermediate part of the exposed conductors 302*a* is bent in an approximately-U-shape so that the leading end part 311 comes closer to the face B of the flat-type flexible cable 300; this inverts the end 310 of the flat-type flexible cable 300. In FIG. 11, as the end 310 is inverted, the face B is shown slightly. The first connector 100 is to be connected to this end 310. In other words, as illustrated on the left side of FIG. 12, the retaining member 120 of the cable holder 103 is kept apart from the end face 103*a*, then, as illustrated on the left side of FIG. 13, the end 310 is mounted on the cable holder 103 so that the end face of the leading end part 311 of the inverted end 310 comes to rest on the stopper 103*d*, then the retaining member 120 is set on the leading end part 311 contacting the end face 103*a*. Next, as illustrated on the left side of FIG. 14, the cable holder 103 is made to oppose to the first connector body 110, and as illustrated on the left side of FIG. 15, the cable holder 103 is fitted with the first connector body 110 to complete the first connector 100. As a result, the face B of the first connector 100 comes to the same side as the face A of the flat-type flexible cable. Then, the first connector 100 is connected to the second connector 200 mounted on the printed wiring board 500. As a result, as illustrated on the left side of FIG. 15, the face B of the second connector 200 comes to the same side as the face A of the flat-type flexible cable 300. Then, as illustrated on the right side of FIG. 11, the other end 310 of the flat-type flexible cable 300 is connected to the first connector 100 in the connection form similar to the case of the above-mentioned 1-N connection. In other words, the insulating coating 301 of the other end 310 of the flat-type flexible cable 300 is removed except the leading end part 311 to expose the conductors 302. Then, an intermediate part of the exposed conductors 302 is bent in an approximately-U-shape so that the leading end part 311 comes closer to the face A of the flat-type flexible cable 300, and in turn, the end 310 of the flat-type flexible cable 300 is inverted. Next, the first connector 100 is connected to this end 310. Then, the first connector 100 is connected to the second connector 200 mounted on the printed wiring board 500. As a result, as illustrated on the right side of FIG. 15, the face A of the flat-type flexible cable 300, the face A of the first connector 100 and the face A of the second connector 200 come to the same side. Thus, with the flat-type flexible cable 300 extending straight in between, two first connectors 100 are opposed to each other in mutually opposite positions in the thickness direction, and in parallel with this, the second connectors 200 are opposed to each other in mutually opposite positions in the thickness direction; thus the 1-1 connection is realized. In this connection form, the triangular marks of the first connector 100 and the second connector 200 of one side are opposed to the triangular marks of the first connector 100 and the second connector 200 of the other side, and the first poles of the first connector 100 and the second connector 200 of one side connect, via the conductor 302 of the flat-type flexible cable 300, to the first poles of the first connector 100 and the second connector 200 of the other side.

As described above, at the time of production of the harness, the end 310 of the flat-type flexible cable 300 is so inverted that the leading end part 311 thereof comes closer to the face A or the face B of the flat-type flexible cable 300, and the positions in the thickness direction of the first connector 100 and the second connector 200 that are connected to the end 310 change accordingly; thus this allows choice between 1-N connection and 1-1 connection at will. In this case, although there is a difference that the leading end part 311 of the end 310 of the flat-type flexible cable 300 is inverted to come closer to the face A of the flat-type flexible cable 300 or closer to the face B thereof, the positioning of the exposed conductors 302*a* in relation to the cable holder 103 does not change, hence just one kind of terminal is needed for the terminals 220 of the second connector 200, and there is no need of increasing the kinds of the terminal 220; this reduces the cost. Moreover, in contrast to the conventional practice, no reinforcing sheet is attached to the flat-type flexible cable 300, hence there is no need of increasing the kinds of the flat-type flexible cable 300, and this reduces the cost. Furthermore, like this embodiment, if the terminals 220 are of a two-contact-point type wherein contact points are provided on both sides in the thickness direction of the cable holder 103, both the contact points will contact the exposed conductor 302*a*, hence there is no possibility of defects such as feeling odd in responses at the time of insertion or withdrawal and generation of damages on the flat-type flexible cable 300 due to repeated insertion and withdrawal; reliable insertion and withdrawal is provided.

It is sufficient for the pair of flat-type flexible cable connectors of the present invention that they are so structured that they prevent reverse connection, namely, connecting the inverted end of the flat-type flexible cable to the first connector the other way around in the thickness direction. To be more specific, when the position of the first connector is considered as the basis for analysis, to which side in the thickness direction the leading end part of the end of the flat-type flexible cable being connected to the first connector is inverted is within the scope of discretion of design; however, once one position is determined as a normal connection, reverse connection, namely, inversion of the leading end part the other way around in the thickness direction, must be prevented. Now, the cable holder may be integrally provided on the first connector without dividing the cable holder from the first connector. In the case of the pair of flat-type flexible connectors of said embodiment, the first connector 100 is divided into the first connector body 110 and the cable holder 103; the cable holder 103 is inserted into the through hole 111 of the first connector body 110 in such a way that one end in the depth direction thereof protrudes into the side of fitting with the second connector 200, so as to fit the cable holder 103 with the first connector body 110; they are structured to prevent reverse mounting, namely, mounting the inverted end 310 of the flat-type flexible cable 300 on the cable holder 103 the other way around in the thickness direction; and the fitting parts of the cable holder 103 and the first connector body 110 are made asymmetrical in the thickness direction to prevent reverse fitting, namely, fitting the cable holder 103 into the first connector body 110 the other way around in the thickness direction. With this arrangement, when the end 310 of the flat-type flexible cable 300 is mounted on the cable holder 103, and they are fitted into the through hole 111 of the first connector body 110, the first connector 100 will be connected to the end 310 of the flat-type flexible cable 300, hence the workability is high and moreover, reverse mounting of the flat-type flexible cable 300 on the cable holder 103 and reverse fitting of the cable holder 103 into the first connector body 110 are prevented; thus 1-N connection or 1-1 connection can be made reliably.

It is sufficient for the pair of flat-type flexible cable connectors of the present invention that they are structured to prevent reverse mounting, namely, mounting the inverted end of the flat-type flexible cable on the cable holder the other way around in the thickness direction. As to this, in the case of the pair of flat-type flexible cable connectors of said embodiment, the stopper 103*d* is provided on one end face 103*a* in the thickness direction of the cable holder 103; the end face of the leading end part 311 of the end 310 of the flat-type flexible cable 300 rests on the stopper 103*d*. With this arrangement, if reverse mounting of the flat-type flexible cable 300 on the cable holder 103 is attempted, mounting of the flat-type flexible cable 300 will be hindered by the stopper 103*d*, thus this reverse mounting is prevented, and in turn, 1-N connection or 1-1 connection is done reliably. Moreover, positioning of the end 310 in relation to the cable holder 103 can be done with high precision, and the exposed conductors 302*a* can be positioned accurately in target locations. In place of the stopper, for example, a groove extending in the width direction and concaving in the thickness direction may be provided in one end face of the cable holder 103, and the leading end part of the flat-type flexible cable may be inserted into the groove.

Furthermore, when the cable holder is integrally provided on the first connector, provision of the above-mentioned stopper or groove on the cable holder is effective in preventing reverse mounting of the inverted end of the flat-type flexible cable, and in such case, reverse connection of the inverted end of the flat-type flexible cable on the first connector is effectively prevented by said prevention of reverse mounting.

The pair of flat-type flexible cable connectors of the present invention may, without provision of any retaining member, clamp the leading end part of the end of the flat-type flexible cable by a lateral wall of the first connector body and an end face of the cable holder, and clamp the root end part by a lateral wall of the first connector body and an end face of the cable holder. In contrast to this, in the case of the pair of flat-type flexible cable connectors of said embodiment, the cable holder 103 is provided with the retaining member 120, which is provided so that the clearance between the retaining member 120 and the end face 103*a* of the cable holder 103 in the thickness direction can be varied, is pressed by the lateral wall 104 constituting the through hole 111 in the first connector body 110, and clamps the leading end part 311 of the end 310 of the flat-type flexible cable 300 between itself and the end face 103*a* of the cable holder 103. With this arrangement, when the retaining member 120 is pressed against or made to dig into the flat-type flexible cable 300, retention of the end 310 of the flat-type flexible cable 300 by the first connector 100 is enhanced. Moreover, depending on configuration, if reverse mounting of the flat-type flexible cable 300 on the cable holder 103 is attempted, mounting of the flat-type flexible cable 300 will be hindered by the retaining member 120, hence this reverse mounting is prevented, and 1-N connection or 1-1 connection is made reliably. It is sufficient for the retaining member that the retaining member is provided on the cable holder so that the retaining member clamps the leading end part or the root end part of the end of the flat-type flexible cable between the retaining member and an end face of the cable holder. Accordingly, the retaining member may be a member, of which clearance from the end face in the thickness direction of the cable holder can be varied and which is biased by an elastic member toward said end face. In that case, the cable holder may be integrally provided on the first connector.

With the embodiment described so far, a harness 410 of flat-type flexible cable has been fully disclosed. Said harness 410 comprises the flat-type flexible cable 300 comprising a plurality of conductors 302 laid side by side in the flat-type insulating coating 301 and having the ends 310 with the insulating coating 301 being removed except the leading end part 311 to expose conductors 302, and the first connectors 100 of the pair of flat-type flexible cable connectors of the present invention, said first connectors 100 being mounted on both the ends 310 of the flat-type flexible cable 300, said two ends 310 being inverted on the same side. 1-N connection is realized by this harness 410 and the second connectors 200.

Moreover, with the embodiment described so far, a harness 420 of flat-type flexible cable has been fully disclosed. Said harness 420 comprises the flat-type flexible cable 300 comprising a plurality of conductors 302 laid side by side in the flat-type insulating coating 301 and having the ends 310 with the insulating coating 301 being removed except the leading end parts 311 to expose conductors 302, and the first connectors 100 of the pair of flat-type flexible cable connectors of the present invention, said first connectors 100 being mounted on both the ends 310 of the flat-type flexible cable 300, said two ends 310 being inverted on mutually opposite sides. 1-1 connection is realized by this harness 420 and the second connectors 200.

The present invention includes embodiments wherein the features of the embodiments described so far are combined. The embodiments described so far merely show some examples of a pair of flat-type flexible cable connectors and harnesses of flat-type flexible cable according to the present invention. Accordingly, a pair of flat-type flexible cable connectors and a harness of flat-type flexible cable according to the present invention must not be construed limitedly by the description of these embodiments.

The disclosure of Japanese Patent Application No. 2006-180676 filed on Jun. 30, 2006 including specification, drawings and claims is incorporated herein by reference in its entirety.

The invention claimed is:

1. A pair of flat-type flexible cable connectors comprising a first connector to be connected to an end of a flat-type flexible cable comprising a plurality of conductors laid side by side in a flat-type insulating coating, the width direction of the first connector to be aligned with the direction of laying of the conductors; and a second connector to be fitted with or disconnected from the first connector by inserting or withdrawing in a depth direction perpendicular to the width direction;

the first connector being provided with a first connector body and a plate-like cable holder having flat end faces on both sides in a thickness direction perpendicular to both the width direction and the depth direction and having an end in the depth direction protruding into a side of fitting with the second connector, and being structured to make the end of the flat-type flexible cable, said end of the flat-type flexible cable having the insulating coating removed except an insulated leading end part to expose the conductors and being inverted by bending an intermediate part of the exposed conductors in an approximately-U-shape, extend and contact both the end faces with the bent part of the exposed conductors serving as a boundary, and hold the insulated leading end part of the end of the flat-type flexible cable and an insulated root end part thereof located opposite to the leading end part with the exposed conductors located in between them, the first connector body having a cable-holder insertion channel extending in the depth direction for receiving and releasably retaining the cable holder therein by simultaneously applying compressing forces to the insulated leading end part and the insulated root end part being disposed facially opposite the insulated leading end part when the cable holder is at least substantially inserted in the cable-holder insertion channel;

the second connector comprising a second connector body being able to be fitted with the first connector, and a plurality of terminals being provided on the second connector body and laid side by side in the width direction to contact the exposed conductors of the end of the flat-type flexible cable upon fitting the second connector body with the first connector.

2. The pair of flat-type flexible cable connectors according to claim 1, wherein the first connector is divided into a first connector body that is capable of fitting with the second connector and is provided with a through hole penetrating in the depth direction, and a cable holder, the cable holder is fitted in the first connector body by inserting the cable holder in the depth direction into the through hole of the first connector body to make the end thereof protrude into the side of fitting with the second connector.

3. The pair of flat-type flexible cable connectors according to claim 1, wherein one end face in the thickness direction of the cable holder is provided with a stopper on which an end face of the leading end part of the end of the flat-type flexible cable rests.

4. The pair of flat-type flexible cable connectors according to claim 2, wherein one end face in the thickness direction of the cable holder is provided with a stopper on which an end face of the leading end part of the end of the flat-type flexible cable rests.

5. The pair of flat-type flexible cable connectors according to claim 1, wherein the cable holder is provided with a retaining member, which clamps between itself and the end face of the cable holder the insulated leading end part or the insulated root end part of the end of the flat-type flexible cable.

6. The pair of flat-type flexible cable connectors according to claim 2, wherein the cable holder is provided with a retaining member, which clamps between itself and the end face of the cable holder the insulated leading end part or the insulated root end part of the end of the flat-type flexible cable.

7. The pair of flat-type flexible cable connectors according to claim 3, wherein the cable holder is provided with a retaining member, which clamps between itself and the end face of the cable holder the insulated leading end part or the insulated root end part of the end of the flat-type flexible cable.

8. The pair of flat-type flexible cable connectors according to claim 4, wherein the cable holder is provided with a retaining member, which clamps between itself and the end face of the cable holder the insulated leading end part or the insulated root end part of the end of the flat-type flexible cable.

9. A harness of flat-type flexible cable comprising a flat-type flexible cable comprising a plurality of conductors laid side by side in a flat-type insulating coating and having an end in which the insulating coating being removed except a leading end part to expose the conductors; and the first connectors of the pair of flat-type flexible cable connectors according to claim 1, the first connectors being mounted on both the ends of the flat-type flexible cable; and the two ends being inverted on the same side.

10. A harness of flat-type flexible cable comprising a flat-type flexible cable comprising a plurality of conductors laid side by side in a flat-type insulating coating and having an end in which the insulating coating being removed except a leading end part to expose the conductors; and the first connectors of the pair of flat-type flexible cable connectors according to claim 2, the first connectors being mounted on both the ends of the flat-type flexible cable; and the two ends being inverted on the same side.

11. A harness of flat-type flexible cable comprising a flat-type flexible cable comprising a plurality of conductors laid side by side in a flat-type insulating coating and having an end in which the insulating coating being removed except a leading end part to expose the conductors; and the first connectors of the pair of flat-type flexible cable connectors according to claim 3, the first connectors being mounted on both the ends of the flat-type flexible cable; and the two ends being inverted on the same side.

12. A harness of flat-type flexible cable comprising a flat-type flexible cable comprising a plurality of conductors laid side by side in a flat-type insulating coating and having an end in which the insulating coating being removed except a leading end part to expose the conductors; and the first connectors of the pair of flat-type flexible cable connectors according to claim 5, the first connectors being mounted on both the ends of the flat-type flexible cable; and the two ends being inverted on the same side.

13. A harness of flat-type flexible cable comprising a flat-type flexible cable comprising a plurality of conductors laid side by side in a flat-type insulating coating and having an end in which the insulating coating being removed except a leading end part to expose the conductors; and the first connectors of the pair of flat-type flexible cable connectors according to claim 1, the first connectors being mounted on both the ends of the flat-type flexible cable; and the two ends being inverted on the mutually-opposite sides.

14. A harness of flat-type flexible cable comprising a flat-type flexible cable comprising a plurality of conductors laid side by side in a flat-type insulating coating and having an end in which the insulating coating being removed except a leading end part to expose the conductors; and the first connectors of the pair of flat-type flexible cable connectors according to claim 2, the first connectors being mounted on both the ends of the flat-type flexible cable; and the two ends being inverted on the mutually-opposite sides.

15. A harness of flat-type flexible cable comprising a flat-type flexible cable comprising a plurality of conductors laid side by side in a flat-type insulating coating and having an end in which the insulating coating being removed except a leading end part to expose the conductors; and the first connectors of the pair of flat-type flexible cable connectors according to claim 3, the first connectors being mounted on both the ends of the flat-type flexible cable; and the two ends being inverted on the mutually-opposite sides.

16. A harness of flat-type flexible cable comprising a flat-type flexible cable comprising a plurality of conductors laid side by side in a flat-type insulating coating and having an end in which the insulating coating being removed except a leading end part to expose the conductors; and the first connectors of the pair of flat-type flexible cable connectors according to claim 5, the first connectors being mounted on both the ends of the flat-type flexible cable; and the two ends being inverted on the mutually-opposite sides.

17. A cable connector assembly for connecting to an end of a flat-type flexible cable having plurality of conductors laid side by side in a flat-type insulating coating, the cable connector assembly comprising:

a first connector extending in a length direction, a width direction and a height direction with the length direction, the width direction and the height direction being oriented perpendicularly relative to one another, the first connector including a first connector body and a cable holder body, the first connector having a first connector body piece and a second connector body piece connected to each other to form a cable holder channel disposed therebetween, the cable holder channel having a cable-capture channel portion and a cable-exposure channel portion in communication with the cable-capture channel portion, the cable holder body including a cable holder and a retaining member connected to the cable holder, the cable holder having the flat-type flexible cable being wrapped thereabout in a U-shaped configuration as viewed in cross-section, the cable holder channel sized to slidably receive the cable holder body with the flat-type flexible cable wrapped about the cable holder such that, upon insertion of the cable holder body into the cable holder channel, the retainer member in contact with the first connector body piece in the cable-capture channel portion presses against one side of the wrapped flat-type flexible cable and causes a diametric side of the wrapped flat-type flexible cable to be pressed between the cable holder body and the second connector body piece in the cable-capture channel portion; and a second connector including a second connector body sized to receive and releasably retain the first connector and a plurality of terminals provided on the second connector body and laid side by side in the width direction to contact the exposed conductors of the end of the flat-type flexible cable in the cable-exposure channel portion of the cable holder channel upon fitting the second connector body with the first connector.

* * * * *